US006730466B2

(12) United States Patent
Ihama et al.

(10) Patent No.: US 6,730,466 B2
(45) Date of Patent: May 4, 2004

(54) SILVER HALIDE PHOTOGRAPHIC EMULSION AND SILVER HALIDE PHOTOGRAPHIC LIGHT-SENSITIVE MATERIAL USING THE SAME

(75) Inventors: Mikio Ihama, Minami-Ashigara (JP); Genichi Furusawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 86 days.

(21) Appl. No.: 10/034,077

(22) Filed: Jan. 3, 2002

(65) Prior Publication Data

US 2002/0150847 A1 Oct. 17, 2002

(30) Foreign Application Priority Data

Jan. 11, 2001 (JP) ..... 2001-003901

(51) Int. Cl.[7] ..... G03C 1/005; G03C 1/494
(52) U.S. Cl. ..... 430/567; 430/569
(58) Field of Search ..... 430/567, 569

(56) References Cited

U.S. PATENT DOCUMENTS 5,494,789 A 2/1996 Daubendiek et al.
5,496,694 A * 3/1996 Kikuchi et al. ..... 430/567
6,100,019 A 8/2000 Brust et al.
6,338,940 B1 1/2002 Miyazawa et al.
6,432,626 B1 * 8/2002 Sugimoto et al. ..... 430/567
6,544,725 B2 * 4/2003 Morimoto ..... 430/567
2002/0061482 A1 5/2002 Ihama et al.

* cited by examiner

*Primary Examiner*—Geraldine Letscher
(74) *Attorney, Agent, or Firm*—Sughrue Mion, PLLC

(57) ABSTRACT

A silver halide photographic emulsion comprises silver iodochlorobromide tabular grains each having (111) faces as main planes thereof. 70% or more of the total projected area of all the grains contained in the emulsion is occupied by grains each meeting conditions (i) to (iv): (i) a hexagonal tabular grain whose ratio of the length of an edge having the maximum length with respect to the length of an edge having the minimum length, is 2 or less; (ii) an epitaxial junction portion having a silver chloride content of 5 mol % or more and 25 mol % or less, is provided on at least one apex portion of the hexagon; (iii) a silver chloride content thereof is 0.5 mol % or more and 6 mol % or less; and (iv) a silver iodide content thereof is 0.5 mol % or more and 10 mol % or less.

20 Claims, 1 Drawing Sheet

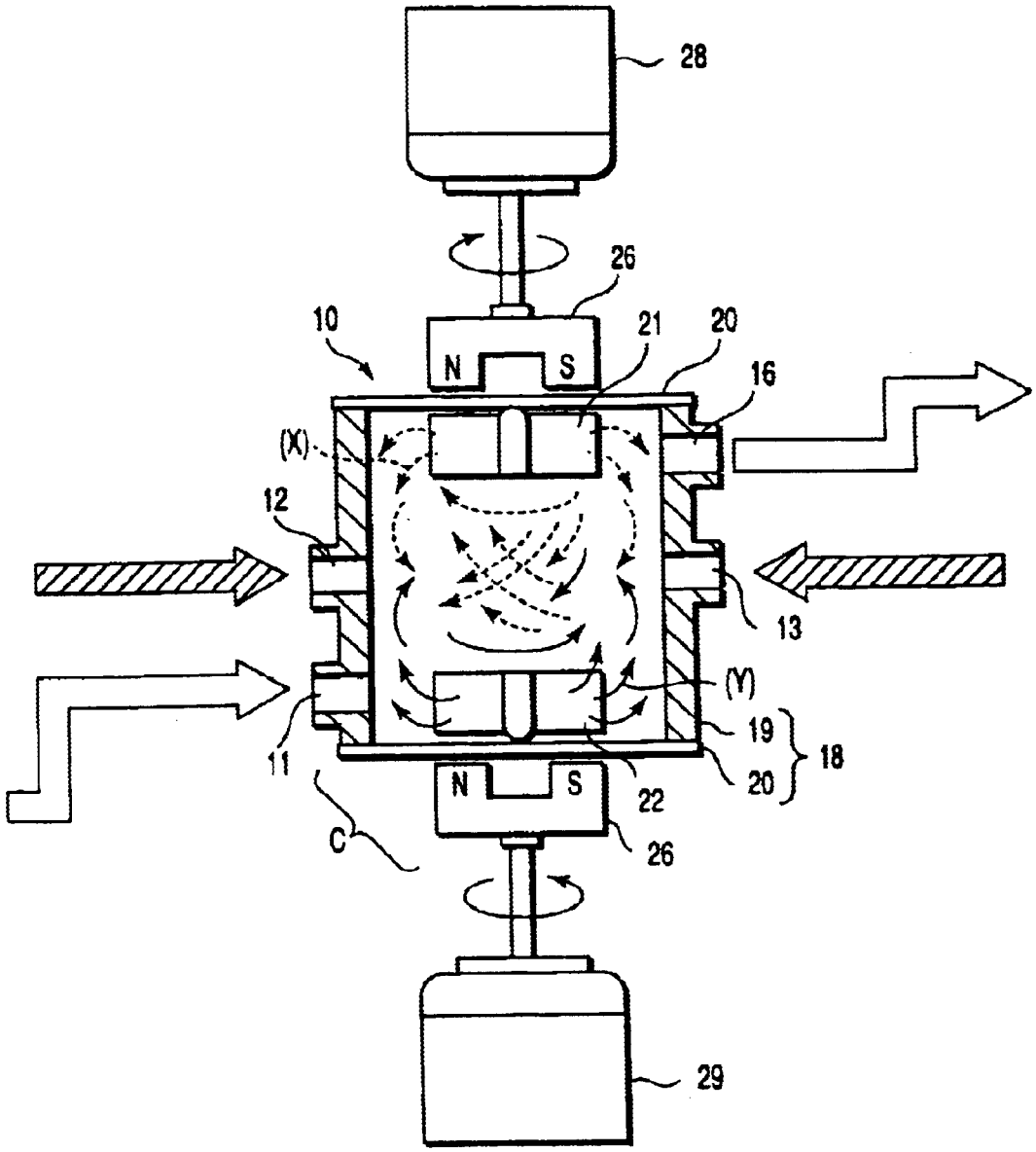
FIGURE

SILVER HALIDE PHOTOGRAPHIC EMULSION AND SILVER HALIDE PHOTOGRAPHIC LIGHT-SENSITIVE MATERIAL USING THE SAME

CROSS-REFERENCE TO RELATED APPLICATIONS

This application is based upon and claims the benefit of priority from the prior Japanese Patent Application No. 2001-003901, filed Jan. 11, 2001, the entire contents of which are incorporated herein by reference.

BACKGROUND OF THE INVENTION

1. Field of the Invention

The present invention relates to a silver halide photographic emulsion and a silver halide photographic light-sensitive material using the same. In more detail, the present invention particularly concerns a high-speed silver halide photographic emulsion whose development proceeds fast, and to a silver halide photographic light-sensitive material using the same.

2. Description of the Related Art

It is well known that to obtain a high-speed silver halide photographic light-sensitive material, tabular silver halide grains (hereinafter referred to as "tabular grains") are used. As a method for sensitizing such tabular grains, sensitizing methods using an epitaxial junction are disclosed in Jpn. Pat. Appln. KOKAI Publication No. (hereinafter referred to as JP-A-) 58-108526 and JP-A-59-133540. Further, applications of the methods to tabular grains each having a smaller thickness or a greater equivalent-circle diameter are disclosed in JP-A's-8-69069, 8-101472, 8-101474, 8-101475, 8-171162, 8-171163, 8-101473, 8-101476, 9-211762 and 9-211763 and U.S. Pat. Nos. 5,612,176, 5,614,359, 5,629,144, 5,631,126, 5,691,127 and 5,726,007. However, the epitaxial sensitizing method, which uses silver chloride as one of the major constituents, is basically unstable as a light-sensitive material for photography fabricated using silver iodobromide as a fundamental constituent. This is because silver chloride has a solubility product greater than those of silver bromide and silver iodide and, therefore, silver halide conversion is liable to occur. Thus, a light-sensitive material in which an epitaxial emulsion is used has a drawback in that the development speed, especially that in high density portions, is slow. For this reason, epitaxial sensitization method cannot be widely used for light-sensitive materials for general photography.

The inventors of the present invention focused their attention on the fact that in conventional epitaxial emulsions, an epitaxial junction is easily broken during ripening, and the degree thereof is influenced by the halogen composition in the epitaxial portion and/or the structure of the side surfaces of the host tabular grain that receives the epitaxial junction. In conventional epitaxial emulsions using silver chloride, the silver chloride content in epitaxial junction portions is higher than 28 mol %, as described in the above-listed patents. Formation of the side surface structure of the host tabular grains is carried out by addition of an aqueous silver salt solution and an aqueous bromide salt solution. In this process, introduction of silver iodide is conducted, as described in the above-listed patents, by simultaneous addition of a silver iodide Lippmann emulsion. However, this method does not enable free control of the side surface structure of the host grains, since the dissolving speed of silver iodide emulsion grains is limited by the large size of the trains. JP-A-2-188741 discloses a method of forming host tabular grains by adding and dissolving only a silver iodobromide fine grain emulsion prepared immediately before its addition. However, this method also does not enable free control of the side surface structure of host tabular grains, because dissolution of the silver iodobromide fine grain emulsion is extremely slowed due to the increase in the content of silver iodide.

BRIEF SUMMARY OF THE INVENTION

The object of the present invention is to provide a silver halide photographic emulsion capable of satisfying simultaneously both the enhancement of sensitivity and problem of delay in the development progress, the emulsion having characteristics of low fogging, high sensitivity, rapid development progress and hard gradation, and also to provide a silver halide photographic light-sensitive material using the same.

The inventors of the present invention found that instability of epitaxial emulsions can be overcome by controlling the silver chloride content in epitaxial junction portions and that the side surface structure of tabular grains can be freely controlled by forming host tabular grains by adding a silver iodobromide fine grain emulsion prepared immediately before its addition. Further, they found that when this method is used to form epitaxial junction portions, thereby to increase the (111) ratio of the side surfaces, epitaxial junctions occurred only restrictedly in apex portions of the tabular grains, resulting in an enhancement of the development speed. The inventors have accomplished the present invention through these findings.

That is, the above objects are attained by the following means (1) to (15):

(1) A silver halide photographic emulsion comprising silver iodochlorobromide tabular grains each having (111) faces as main planes thereof, wherein 70% or more of the total projected area of all the grains contained in the emulsion is occupied by grains each meeting conditions (i) to (iv) below:
  - (i) a hexagonal tabular grain whose ratio of the length of an edge having the maximum length with respect to the length of an edge having the minimum length, is 2 or less,
  - (ii) an epitaxial junction portion having a silver chloride content of 5 mol % or more and 25 mol % or less, is provided on at least one apex portion of the hexagon,
  - (iii) a silver chloride content thereof is 0.5 mol % or more and 6 mol % or less, and
  - (iv) a silver iodide content thereof is 0.5 mol % or more and 10 mol % or less.

(2) A silver halide photographic emulsion comprising silver iodochlorobromide tabular grains each having (111) faces as main planes thereof, wherein the tabular grains each having a ratio of (111) face to the side surfaces of 75% or more, and 70% or more of the total projected area of all the grains contained in the emulsion is occupied by grains each meeting conditions (i), (ii'), (iii) and (iv) below:
  - (i) a hexagonal tabular grain whose ratio of the length of an edge having the maximum length with respect to the length of an edge having the minimum length, is 2 or less,
  - (ii') an epitaxial junction portion is provided on at least one apex portion of the hexagon,
  - (iii) a silver chloride content thereof is 0.5 mol % or more and to 6 mol % or less (iv) a silver iodide content thereof is 0.5 mol % or more and 10 mol % or less.

(3) The silver halide photographic emulsion according to item (2), wherein the epitaxial junction portion has a silver chloride content of 5 mol % or more and 25 mol % or less.

(4) The silver halide photographic emulsion according to item (1) or (3), wherein the silver chloride content of the epitaxial junction portion is 10 mol % or more and 20 mol % or less.

(5) The silver halide photographic emulsion according to any one of items (1), (3) and (4), wherein the silver iodide content of the epitaxial junction portion is 1 mol % or more and 10 mol % or less.

(6) The silver halide photographic emulsion according to item (2) or (3), wherein the ratio of (111) face to the side surfaces is 85% or more.

(7) The silver halide photographic emulsion according to any one of items (1) to (6), wherein each of the grains occupying 70% or more of the total projected area further meeting condition (v) below:

(v) an equivalent-circle diameter thereof is 0.3 μm or more and the thickness is 0.2 μm or less.

(8) The silver halide photographic emulsion according to any one of items (1) to (7), wherein the variation coefficient of equivalent-circle diameters of all the grains contained in the emulsion is 30% or less.

(9) The silver halide photographic emulsion according to any one of items (1) to (8), wherein each of the grains occupying 70% or more of the total projected area further meeting condition (vi) below in addition to the conditions (i) to (iv); (i), (ii'), (iii) and (iv); (i) to (v); or (i), (ii'), (iii), (iv) and (v):

(vi) an equivalent-circle diameter thereof is from 0.5 μm to 1.2 μm and a thickness thereof is 0.1 μm or less.

(10) The silver halide photographic emulsion according to any one of items (1) to (9), wherein the grains occupying 70% or more of the total projected area further meeting condition (vii) below in addition to the conditions (i) to (iv); (i), (ii'), (iii) and (iv); (i) to (v); (i), (ii'), (iii), (iv) and (v); (i) to (vi); (i), (ii'), (iii), (iv), (v) and (vi):

(vii) no dislocation lines are present anywhere other than the epitaxial junction portion.

(11) The silver halide photographic emulsion according to any one of items (1) to (10), wherein host tabular grains on which the epitaxial junction portion is deposited were formed by adding a silver iodide fine grain emulsion prepared immediately before the addition thereof.

(12) The silver halide photographic emulsion according to any one of items (5) to (11), wherein the epitaxial portion was formed by adding a silver iodide fine grain emulsion prepared immediately before the addition thereof.

(13) The silver halide photographic emulsion according to item (11) or (12), wherein the grain size of the silver iodide fine grain emulsion is 0.02 μm or less.

(14) The silver halide photographic emulsion according to item (13), wherein the grain size of the silver iodide fine grain emulsion is 0.01 μm or less.

(15) A silver halide photographic light-sensitive material comprising a support having thereon a silver halide light-sensitive silver halide layer containing the silver halide photographic emulsion according to any one of items (1) to (14).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

A single FIGURE is a sectional view showing an out line of a mixing apparatus used in an embodiment of the present invention.

DETAILED DESCRIPTION OF THE INVENTION

Silver halide photographic emulsions of the present invention will be described below.

In the present invention, a tabular grain is a silver halide grain having two opposing, parallel (111) main planes. A tabular grain used in the present invention has one twin face or two or more parallel twin faces. A twin face is a (111) face on both sides of which ions at all lattice points have a mirror image relationship.

In the present invention, it is preferable that 75% or more of all side surfaces connecting the opposing (111) main planes of the tabular grain be constituted by (111) faces.

"75% or more of all side surfaces are constituted by (111) faces" means that crystallographic surfaces other than (111) faces exist at a ratio lower than 25% of all side surfaces. It is generally understood that such surfaces are (100) surfaces, but some other surfaces such as (110) surfaces or higher-index surfaces may also exist. The effect of the present invention is remarkable when 85% or more of all side surfaces are constituted by (111) faces.

Whether 75% or more of all side surfaces of a tabular grain are constituted by (111) faces can be judged primarily from a shadowed electron micrograph of the grain obtained by the carbon replica method. When 75% or more of side surfaces are constituted by (111) faces in a hexagonal tabular grain, six side surfaces directly connecting to the (111) main planes alternately connect at acute and obtuse angles to the (111) main planes. On the other hand, when 70% or less of all side surfaces are constituted by (111) face in a hexagonal tabular grain, all six side surfaces directly connecting to the (111) main planes connect at obtuse angles to the (111) main planes. By performing shadowing at an angle of 50° or less, it is possible to distinguish between obtuse and acute angles of side surfaces with respect to the main planes. Shadowing at an angle of preferably 10° or more and 30° or less facilitates distinguishing between obtuse and acute angles.

As a method of determining the ratio of (111) faces to (100) surfaces precisely, a method which uses adsorption of sensitizing dyes is effective. The ratio of (111) faces to (100) surfaces can be quantitatively obtained by using the method described in the Journal of the Japan Chemical Society, 1984, Vol. 6, pp. 942–947. That is, by use of this ratio and the equivalent-circle diameter described below and thickness of a tabular grain, it is possible to calculate the ratio of (111) faces in all side surfaces. In this case it is assumed that a tabular grain is a circular cylinder having diameter and height that correspond to the equivalent-circle diameter and the thickness, respectively. On the basis of this assumption, the ratio of side surfaces to the total surface area can be obtained. The value obtained by dividing the ratio of (100) surfaces, which is obtained using adsorption of sensitizing dyes as described above, by the ratio of side surfaces and multiplying the quotient by 100 is the ratio of (100) surfaces in all side surfaces. Subtracting this value from 100 yields the ratio of (111) faces in side surfaces of the grains in the present invention.

In an emulsion of the present invention, tabular grains each having a hexagonal main plane with a ratio of the length of an edge having the maximum length with respect to the length of an edge having the minimum length of from 2 to 1 occupy 70% or more of the total projected area of all the grains. Preferably, tabular grains each having a hexagonal main plane with a ratio of the length of an edge having the maximum length with respect to the length of an edge having the minimum length of from 2 to 1 occupy 90% or more of the projected area of all the grains. More preferably, tabular grains each having a hexagonal main plane with a ratio of the length of an edge having the maximum length with respect to the length of an edge having the minimum length of from 1.5 to 1 occupy 90% or more of the total projected area.

In an emulsion of the present invention, the variation coefficient of equivalent-circle diameters of all grains is 30% or less. An emulsion of the present invention is preferably monodisperse. The variation coefficient of the equivalent-circle diameters of all the silver halide grains used in the present invention is preferably 30% or less, more preferably, 25% or less, and most preferably, 20% or less. The variation coefficient of equivalent-circle diameters means the value obtained by dividing the standard deviation of the distribution of the equivalent-circle diameters of individual silver halide grains by the average equivalent-circle diameter.

The equivalent-circle diameter of a tabular grain is obtained, for example, by taking a transmission electron micrograph by the replica method and determining the diameter (equivalent-circle diameter) of a circle having an area equal to the projected area of each individual grain. The thickness cannot be calculated simply from the length of the shadow of a replica due to epitaxial deposition. However, it can be calculated by measuring the length of a shadow of a replica before epitaxial deposition. Alternatively, it can easily be obtained even after epitaxial deposition by cutting a sample coated with tabular grains and taking an electron micrograph of the section.

70% or more of the total projected area of the tabular grains used in the present invention is preferably occupied by tabular grains each having an equivalent-circle diameter of 0.3 $\mu$m or more and a thickness of preferably 0.2 $\mu$m or less. More preferably, 70% or more of the total projected area is occupied by tabular grains each having an equivalent-circle diameter of 0.3 $\mu$m or more and 1.2 $\mu$m or less and a thickness of 0.1 $\mu$m or less. Particularly preferably, 90% or more of the total projected area is occupied by tabular grains each having an equivalent-circle diameter of 0.3 $\mu$m or more and 1.2 $\mu$m or less and a thickness of 0.1 $\mu$m or less. Most preferably, 90% or more of the total projected area is occupied by tabular grains each having an equivalent-circle diameter of 0.5 $\mu$m or more and 1.2 $\mu$m or less and a thickness of 0.1 $\mu$m or less. As the equivalent-circle diameter and the thickness become smaller, it becomes more difficult to control of the ratio of (111) faces in side surfaces, and therefore the effect of the present invention is especially remarkable.

Tabular grains used in the present invention are silver iodochlorobromide. Basically, the tabular grains are configured with a combination of host tabular grains that are formed of silver iodobromide or silver iodochlorobromide, and epitaxial junction portion(s) that are formed of silver chloride or silver chlorobromide or silver iodochlorobromide. The silver chloride content in tabular grains of the present invention is 0.5 mol % or more and 6 mol % or less. More preferably, the silver chloride content is 0.7 mol % or more and 5 mol % or less. The silver iodide content in tabular grains of the present invention is 0.5 mol % or more and 10 mol % or less. More preferably, the silver chloride content is 1 mol % or more and 6 mol % or less.

In the present invention, it is preferable that 70% or more of the total projected area is occupied by grains each having a silver chloride content in the range of 0.7 to 1.3 CL, more preferably 0.8 to 1.2 CL, provided that CL (mol %) represents the average silver chloride content of all the grains. More preferably, 70% or more of the total projected area is occupied by grains each having a silver iodide content in the range of 0.7 to 1.3 I, more preferably 0.8 to 1.2 I, provided that I (mol %) represents the average silver iodide content of all the grains. Generally, the EPMA (Electron Probe Micro Analyzer) method is effective in the measuring of the silver chloride or silver iodide content of each individual grain. In this method, a sample wherein emulsion grains are dispersed so as to avoid contacting thereof to each other is prepared. The sample is irradiated with electron beams to thereby emit X-rays. Analysis of the X-rays enables performing an elemental analysis of an extremely minute region irradiated with electron beams. The measuring is preferably performed while cooling the sample in order to prevent the damaging of the sample by electron beams.

In the emulsion of the present invention, 70% or more of the total projected area is occupied by tabular grains each having at least one epitaxial junction portion on at least one apex portion of the six apex portions of the hexagonal main plane. More preferably, 90% or more of the total projected area is occupied by tabular grains each having at least one epitaxial junction portion on at least one apex portion of the six apex portions of the hexagonal main plane. Herein the apex portion means that when viewed from the position perpendicular to the main plane, a portion within a circle having a radius of a length of ⅓ of the shorter side selected from the two neighboring sides that form the apex. When the hexagonal tabular grain has a rounded apex portion, whether the grain satisfies the above requirement or not can be judged using a hypothetical hexagon formed by extending each linear side of the hexagon. The epitaxial emulsion of the invention is an emulsion containing grains each having at least one epitaxial junction portion on this apex portion. The total number of the epitaxial junction portion is preferably six, which means one epitaxial junction portion on each of the six apex portions. Usually, epitaxial junction is formed on a place other than the apex portion of the tabular grain, such as on the main plane of the tabular grain or on edges other than the apex portions of the tabular grain. The epitaxial emulsion of the invention can be distinguished by the following judgment. From electron microgram of the tabular grains using the replica method, 100 or more grains are selected. These grains are classified into three groups, i.e., (i) grains having an epitaxial junction only on at least one apex portion; (ii) grains having an epitaxial junction only on the edge(s) other than the apex potion(s), those having an epitaxial junction only on the main plane other than the apex portion(s), and those having an epitaxial junction only on the edge(s) and main plain, other than the apex portion(s); and (iii) the grains having no epitaxial junction. When the grains classified into the group having an epitaxial junction on at least one apex portion accounts for 70% or more of the total projected area, such emulsion corresponds to the epitaxial emulsion of the invention. More preferably, the ratio of grains having an epitaxial junction on at least one apex portion accounts for 90% or more of the total projected area.

The silver halide composition of the epitaxial junction portion is silver chloride or silver chlorobromide or silver iodochlorobromide. It is preferable that the silver chloride content of the epitaxial junction portion is 5 mol % or more and 25 mol % or less. More preferably, the silver chloride content of the epitaxial junction portion is 10 mol % or more and 20 mol % or less. The silver iodide content of the epitaxial junction portion is 1 mol % or more and 10 mol % or less. By setting the silver chloride content and the silver iodide content within the ranges, the epitaxial junction portion becomes stable, which leads to attaining the advantages of the present invention remarkably.

In the present invention, the silver chloride content and the silver iodide content in epitaxial junction portions can be measured by the following method. The tabular silver halide grains in a silver halide photographic light-sensitive material are taken out by treating the light-sensitive material with a proteolytic enzyme and subjecting the resultant to centrifugation. The resulting grains are redispersed and are laid on a copper mesh having thereon a support film. An epitaxial junction portion of the grains is subjected to spot analysis with a narrowed spot diameter of 2 nm or less using an analytical electron microscope, thereby measuring the silver chloride content and the silver iodide content. The silver chloride content and the silver iodide content can be determined by obtaining, in advance, a ratio between intensity of characteristic X-ray radiation derived from Ag and intensity of characteristic X-ray radiation derived from halogen by using silver halide grains whose contents of silver halides are known and to which the similar processing as mentioned above is conducted. As an analytical line source of the analytic electron microscope, a field emission-type electron gun capable of generating a high electron density is more suitable than that using thermoelectrons. By narrowing the spot diameter to 1 nm or less, the halogen composition in an epitaxial junction portion can be analyzed easily. When the intergrain variation coefficient of halogen content in the epitaxial junction portion is 30% or less, the halogen content is obtained usually by measuring halogen contents in twenty grains and then averaging the measurements. When the intergrain variation coefficient of halogen content in the epitaxial junction portion is 20% or less, the halogen content is obtained usually by measuring halogen contents in ten grains and then averaging the measurements. The intergrain variation coefficient of the halogen content is preferably 20% or less. The total amount of silver in the epitaxial junction portion(s) is preferably from 0.5 mol % to 10 mol %, more preferably from 1 mol % to 5 mol % with respect to the amount of silver in the host tabular grains.

In the present invention, 70% or more of the total projected area is occupied by grains having no dislocation line except for the epitaxial junction portion. The dislocation lines provide preferential deposition portion for the epitaxial deposition, thereby inhibit the formation of epitaxial tabular grains of the invention. Preferably, in the present invention, 70% or more of the total projected area is occupied by grains having no dislocation line, provided that the portion where the epitaxial deposited is excluded. More preferably, 90% or more of the total projected area is occupied by grains having no dislocation line. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

Specific process for preparing the above epitaxial emulsion of the present invention will be described in detail below in two parts, the one for the preparation of host tabular grains and the other for the preparation of epitaxial junction portions.

First, the host tabular grains required for the preparation of the epitaxial emulsion will be described. With respect to the intragranular distribution of silver iodide in the host tabular grains of the present invention, grains of double or more multiple structures are preferred. Herein, the expression "having structures with respect to the distribution of silver iodide" means that there is a difference in silver iodide content of 0.5 mol % or more, preferably 1 mol % or more, between structures.

Structures with respect to the distribution of silver iodide can fundamentally be determined by calculation from formulation values for the step of grain preparation. The change of silver iodide content at each interface of structures can be sharp or gentle. In the ascertation thereof, although an analytical measuring precision must be considered, the aforementioned EPMA method is effective. This method enables analyzing the intragranular silver iodide distribution as viewed from a position perpendicular to the main plane of tabular grains. Further, by using a specimen obtained by hardening the grain specimen and slicing the hardened specimen with the use of a microtome into extremely thin sections, the method also enables analyzing the intragranular silver iodide distribution across the tabular grain section.

In the host tabular grains, it is preferred that the outermost-shell silver iodide content be higher than inner-shell silver iodide contents. The ratio of the outermost shell is preferably in the range of 1 to 40 mol % based on the total silver quantity. The average silver iodide content thereof is in the range of 1 to 30 mol %. Herein, the ratio of the outermost shell refers to the ratio of the amount of silver used in the preparation of the outermost shell to the amount of silver used for obtaining final grains. The average silver iodide content refers to the molar ratio % of the amount of silver iodide used in the preparation of the outermost shell to the amount of silver used in the preparation of the outermost shell. The distribution thereof may be uniform or nonuniform. More preferably, the ratio of outermost shell is in the range of 5 to 20 mol % based on the total silver quantity, and the average silver iodide content thereof is in the range of 5 to 20 mol %.

The preparation of host tabular grains fundamentally consists of a combination of three steps, namely, nucleation, ripening and growth.

In the step of nucleation of grains for use in the present invention, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the present invention, most preferably, an aqueous solution of silver nitrate, an aqueous solution of halide and an oxidation-processed gelatin of low-molecular weight are added within one minute at 20 to 40° C. under agitation in the presence of oxidation-processed gelatin of low-molecular weight. At that time, the pBr and pH values of the system are preferably 2 or higher and 7 or below, respectively. The concentration of the aqueous solution of silver nitrate is preferably 0.6 mol/L or less. The employment of this nucleation method facilitates the formation of the epitaxial tabular grains of the present invention.

In the step of ripening the tabular grain emulsion of the present invention, it is practical to effect ripening in the presence of low-concentration base as described in U.S. Pat. No. 5,254,453, and to carry out ripening at high pH as described in U.S. Pat. No. 5,013,641. It is also practical to add, at the step of ripening or subsequent growth, polyalkylene oxide compounds as described in U.S. Pat. Nos. 5,147,771, 5,147,772, 5,147,773, 5,171,659, 5,210,013 and 5,252,453. In the present invention, the ripening step is preferably performed at 60 to 80° C. Immediately after the nucleation or during the ripening, the pBr is preferably lowered to 2 or below. Additional gelatin is preferably added from immediately after the nucleation to the end of ripening. Most preferred gelatin is one having 95% or more of its amino groups modified into succinate or trimellitate. The employment of such gelatins facilitates the formation of the epitaxial tabular grains of the present invention.

In the step of growth, it is preferably employed to simultaneously add an aqueous solution of silver nitrate, an aqueous solution of halide containing a bromide and a silver iodide fine grain emulsion as described in U.S. Pat. Nos. 4,672,027 and 4,693,964. The silver iodide fine grain emulsion is not limited if it consists substantially of silver iodide, and may contain silver bromide and/or silver chloride as long as mixed crystals can be formed. Preferably, the silver halide composition of the silver iodide fine grain emulsion consists of 100% silver iodide. With respect to the crystalline structure, the silver iodide can have not only β form and γ form but also, as described in U.S. Pat. No. 4,672,026, α form or a structure similar thereto. In the present invention, although the crystalline structure is not particularly limited, it is preferred to employ a mixture of β form and γ form, more preferably β form only.

Although the silver iodide fine grain emulsion may be one prepared immediately before the addition as described in, for example, U.S. Pat. No. 5,004,679, or one having undergone the customary washing, it is preferred in the present invention to employ the silver iodide fine grain emulsion prepared immediately before the addition so as to easily control the (111) face ratio in the side surfaces. Herein, to prepare immediately before the addition means that the time from the preparation to the addition thereof is within 10 min, preferably within 1 min. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of inverse of $I^-$ ion concentration of the system. Although there is no particular limitation with respect to the temperature, pI, pH, type of protective colloid agent such as gelatin, concentration thereof, presence of silver halide solvent, type and concentration thereof, etc., it is advantageous for controlling the (111) face ratio in the side surfaces of the tabular grains of the present invention that the grain size be 0.02 μm or less, preferably 0.01 μm or less. Although the grain configuration cannot be fully specified because of the fine grains, it is preferred that the variation coefficient of the grain size distribution be 25% or less. When it is 20% or less, the advantages of the present invention are especially remarkable.

The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.01 or less and 0.005 μm or more and exhibit a variation coefficient of grain size distribution of 18% or less.

A most preferable method used to add the above silver iodide fine grain emulsion prepared just before being added is the method using a mixer, which is described in JP-A-10-43570, the disclosure of which is incorporated herein by reference.

A mixer is a stirring apparatus comprising: an stirring vessel having a predetermined number of supply ports for flowing water-soluble silver salt and water-soluble halogen salt to be stirred into the vessel, and a discharging port for discharging a silver halide fine grain emulsion generated after stirring processing; and stirring means for controlling the stirring state of the liquid in the stirring vessel by stirring blades being rotation-driven in the stirring vessel. Preferably, the stirring means performs stirring and mixing by at least two stirring blades rotation-driven in the stirring vessel, and the at least two stirring blades are arranged in positions in the stirring vessel with a distance so as to be opposed to each other, and rotation-driven in converse directions each other. Preferably each of the stirring blades is coupled by magnetism to an outside magnet disposed outside the adjacent vessel wall, thereby to form a structure having no shaft piercing through the vessel walls. The stirring blades are rotated by rotation-driving their respective outside magnets by motors disposed outside the vessel. As one of the outside magnets coupled to the stirring blades by magnetic coupling, used is a double sided bipolar magnet comprising an N pole face and an S pole face disposed so as to be parallel to a central axis line of rotation and superposed interposing the central axis of rotation. Further, as the other outside magnet, used is a bilateral bipolar magnet comprising an N pole face and an S pole face standing abreast at symmetrical positions to the central axis of rotation on the plane orthogonal to the central axis line of rotation.

FIG. 1 shows an embodiment of a mixer (stirring apparatus) relating to the present invention.

A mixing vessel 18 comprises a vessel main body 19 with a central axis directed in the vertical direction, and seal plates 20 serving as vessel walls for sealing top and bottom opening ends of the vessel main body 19. Stirring blades 21 and 22 are arranged apart from each other at opposing top and bottom ends in the stirring vessel 18, and rotation-driven in opposite directions. The stirring blades 21 and 22 form magnetic coupling with respective outside magnets 26 arranged outside the vessel walls adjacent to the stirring blades 21 and 122. Specifically, the stirring blades 21 and 22 are coupled to the respective outside magnets 26 by magnetic force, and rotation-driven in converse directions by rotation-driving the outside magnets 26 by independent motors 28 and 29.

The stirring vessel 18 comprises liquid supply ports 11, 12 and 13 for introducing a silver salt aqueous solution, a halogen salt aqueous solution, and if necessary a colloidal solution to be stirred, and a discharge port 16 for discharging a stirred silver halide fine grain emulsion. The silver salt aqueous solution and the halogen salt aqueous solution are preferably added toward the stirring blades, and the angle between the liquid supply ports 11 and 12 is preferably as large as possible. Specifically, 90° is more preferable than 60°, and 180° is further preferable.

A method of preparing the silver iodide fine grain emulsion will now be described. Specifically, the following features are described in detail: (a) number of revolution of stirring; (b) residence time; (c) addition method and the kind of protective colloid; (d) temperature of the added liquids; (e) concentration of the added liquid; and (f) electric potential.

(a) Number of Revolution of Stirring

When the opposing stirring blades in the mixer are driven, their number of revolution is preferably 1,000 rpm to 8,000 rpm, more preferably 3,000 rpm to 8,000 rpm, and most preferably 4,000 rpm to 8,000 rpm. A number of revolution exceeding 15000 rpm is not preferable since it makes the centrifugal forces of the stirring blades too strong, which causes a backward flow toward the addition ports. Further, the stirring blades rotated in converse directions may be rotated at the same number of revolution, or rotated at different numbers of revolution.

(b) Residence Time

The residence time t of the added liquids to be introduced into the mixer is represented by the following formula:

$$t=60V/(a+b+c)$$

t: residence time (second)

V: volume of the mixing space of the mixer (mL)

a: addition current of silver salt solution (mL/minute)

b: addition current of halide salt solution (mL/minute)

c: addition current of protective colloidal solution (mL/minute)

The residence time t is preferably 0.1 to 5 seconds, more preferably 0.1 to 1 second, and most preferably 0.1 to 0.5 seconds. When residence time t exceeds 5 seconds, silver halide fine grains once generated in the mixer grow to a larger size, and its size distribution becomes wider, which is not preferable. Further, the residence time less than 0.1 second is not preferable, since the added liquids remaining unreacted are discharged from the mixer.

(c) Addition Method and the Kind of Protective Colloid

When a protective colloidal aqueous solution is added to the mixer, the following addition methods are used.

a. A protective colloidal solution is singly injected into the mixer. The concentration of the protective colloid is at least 0.5%, preferably 1 to 20%. The flow rate of the colloidal solution is preferably at least 20–300% of the sum of the flow amounts of the silver salt solution and the halide solution, more preferably 50–200%.

b. A protective colloid is made contained in the halide salt solution. The concentration of the protective colloid is at least 0.4%, preferably 1 to 20%.

c. A protective colloid is made contained in the silver salt solution. The concentration of the protective colloid is at least 0.4%, preferably 1 to 20%. If gelatin is used, the silver salt solution and gelatin solution had better be added just before use, since silver ions and gelatin form silver ion complex with gelatin which is photolyzed and pyrolyzed to generate colloidal silver.

The above methods a–c may be used individually, or two or three of them may be used simultaneously in combination with each other.

Further, in the mixer used in the present invention, gelatin is generally used as the protective colloid. Alkaline processing is generally used to process the gelatin. In particular, it is preferable to use alkaline-processed gelatin which has been subjected to deionization and/or ultrafiltration to remove impurity ions and impurities. Besides alkaline-processed gelatin, it is possible to use: gelatin derivatives such as acid-processed gelatin, phthalated gelatin, trimellitated gelatin, succinated gelatin, maleated gelatin and esterified gelatin; low-molecular weight gelatin (having a molecular weight of 1,000 to 80,000, and containing gelatin decomposed by an enzyme, gelatin hydrolyzed with acid and/or alkali, and pyrolyzed gelatin); high molecular-weight gelatin (having a molecular weight of 110,000 to 300,000); gelatin having a methionine content of 40 $\mu$mol/g or less; gelatin having a tyrosine content of 20 $\mu$mol/g or less; oxidized gelatin; and gelatin wherein methionine is inactivated by alkylation. A mixture of two or more kinds of gelatins may be used.

In order to form finer silver halide fine grains by using the mixer, it is necessary to keep the temperatures of the solutions to be added to the mixer as low as possible. However, since gelatin is readily solidified under a temperature not exceeding 35° C., it is preferable to use a low-molecular weight gelatin which is not solidified even under a low temperature. The molecular weight of a low-molecular weight gelatin is preferably 50,000 or less, preferably 30,000 or less, and more preferably 10,000 or less. Further, a synthetic polymer which is a synthetic colloid having a protective colloidal function for the silver halide grains can be used in the present invention, since it also is not solidified under a low temperature. Furthermore, natural polymers other than gelatin can be used in the present invention in the same manner. These are described in Japanese Patent Publication KOKOKU No. (hereinafter referred to as "JP-B-") 7-111550, and "Research Disclosure" Vol. 176, No. 17643 (December, 1978), Section IX, the disclosure of which is incorporated herein by reference.

(d) Temperature of the Added Liquids

The temperatures of the liquids to be added are preferably 10–60° C. However, in view of downsizing and suitability of preparation, the temperatures are more preferably 20–40° C., and most preferably 20–30° C. Further, in order to prevent generation of heat of reaction in the mixer and ripening of the formed silver iodide fine grains, the temperatures of the mixer and the piping are preferably controlled.

(e) Concentration of Added Liquid

In a mixer provided outside the reaction vessel, since generally no dilution by a bulk liquid is performed, using thick addition liquids increases the size of silver iodide fine grains to be formed, and tends to deteriorate the size distribution. However, since the above mixer is superior to conventional stirring apparatuses in stirring and mixing, it has succeeded in forming silver iodide ultrafine grains of a small size and a narrow size distribution even if it uses thick addition liquids. Specifically, the concentrations of the addition liquids are preferably 0.4 mol/liter (hereinafter also denoted as "L") to 1.2 mol/L, more preferably 0.4 to 0.8 mol/L. The concentration of the addition liquid less than 0.4 mol/L is too thin, thus, total silver amount becomes smaller, which is unpractical.

(f) Electric Potential

With respect to the electric potential (halogen excess amount) for forming cubic system silver iodide ultrafine grains, from the viewpoint of downsizing, it is preferable to form the grains at a potential set to a pAg range to have a small solubility. Specifically, pAg is preferably 8.5 to 11.5, more preferably 9.5 to 10.5.

As the result of repeating researches with respect to the above points (a)–(f), the inventors succeeded in preparing cubic system silver iodide ultrafine grains having an average equivalent sphere diameter of 0.008 to 0.019 $\mu$m.

The silver iodide ultrafine grains prepared as described above are immediately supplied to the reaction vessel. The word "immediately" indicates "within 10 minutes", preferably "within 1 minute". Since the grain size of the silver iodide ultrafine grains become larger with the lapse of time, a shorter time is more preferable.

In order to add to the reaction vessel the silver iodide ultrafine grains formed in the mixing vessel outside the reaction vessel, as described above, the grains may be added continuously, or may be added after once being stored in the mixing vessel. Further, these methods may be used together. However, if the grains are temporally stored in the mixing vessel, the temperature is preferably 40° C. or less, and more preferably 20° C. or less. Further, the storing time is preferably as short as possible.

The method for causing 75% or less of all the side surfaces of the host tabular grain emulsion to consist of (111) faces will now be described. The ratio of (111) faces to the side surfaces of the host tabular grain emulsion can be easily regulated by adding the silver iodide fine grain emulsion mentioned above, i.e., silver iodide fine grain emulsion prepared immediately before the addition thereof, during preparation of outermost shell of the tabular host grains. The pBr during the addition of the silver iodide fine grain emulsion is important. Preferably, 30% or more of the silver quantity required for the formation of the outermost shell is added at a pBr set so that the ratio of (111) faces to the side surfaces is increased, that is, the ratio of (100) faces to the side surfaces is decreased. More preferably, 50% or more of the silver quantity required for the formation of the outermost shell is added at a pBr set so that the ratio of (111) faces to the side surfaces is increased.

With respect to such pBr as will increase the ratio of (111) faces to the side surfaces, the value thereof can be widely varied depending on the temperature and pH of system, type of protective colloid agent such as gelatin, concentration thereof, presence of silver halide solvent, type and concentration thereof, etc. Generally, it is preferred that the pBr be 2.0 or less. More preferably, the pBr is 2.5 or less. The pBr is 1 or more is preferable. However, as mentioned above, this pBr value can be easily changed, for example, depending on the presence of a silver halide solvent, etc. Examples of silver halide solvents which can be used in the present invention include organic thioethers (a) described in U.S. Pat. Nos. 3,271,157, 3,531,286 and 3,574,628 and JP-A's-54-1019 and 54-158917, thiourea derivatives (b) described in JP-A's-53-82408, 55-77737 and 55-2982, silver halide solvents having a thiocarbonyl group interposed between an oxygen or sulfur atom and a nitrogen atom (c) described in JP-A-53-144319, imidazoles (d) described in JP-A-54-100717, sulfites (e), ammonia (f) and thiocyanates (g).

Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halides.

The host tabular grains preferably do not have a dislocation line. The dislocation lines can be diminished by combined use of the above-mentioned nucleation, ripening and growth steps.

The epitaxial junction required for the preparation of epitaxial emulsion will now be described. The epitaxial deposition may be carried out immediately after the formation of the host tabular grains, or after customary desalting performed after the formation of host tabular grains. Preferably, the epitaxial deposition is carried out immediately after the formation of the host tabular grains for the epitaxial emulsion of the invention.

For the epitaxial formation immediately after preparation of the host tabular grains, pH, pAg, and a gelatin concentration and viscosity are selected. The gelatin concentration is important, and preferably, 50 g or less per liter, more preferably 5 g or more and 40 g or less per liter. When the gelatin concentration is too small, the epitaxial deposition occurs on main planes of the tabular grains. When the gelatin concentration is too large, viscosity thereof increases, thereby epitaxial deposition becomes uneven between grains.

A sensitizing dye is used as a site-indicating agent (or site director) for the epitaxial junction. The position of epitaxial deposition can be controlled by selecting the amount and type of employed sensitizing dye. Dyes are each preferably added in an amount of 50 to 90% based on a saturated coating quantity. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

These sensitizing dyes may be used either individually or in combination. The sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB Nos. 1,344,281 and 1,507,803, JP-B's-43-4936 and 53-12375, and JP-A's-52-110618 and 52-109925.

The emulsion of the present invention may be loaded with a dye which itself exerts no spectral sensitizing effect or a substance which absorbs substantially none of visible light and exhibits supersensitization, simultaneously with or separately from the above sensitizing dye.

Increased silver iodide content in the surface composition of host tabular grains at the time of adsorption of sensitizing dye is preferred from the viewpoint of preparation of epitaxial tabular grains. Thus, addition of iodide ions is effected prior to the incorporation of sensitizing dye. The addition amount of such iodide ions or silver iodide is preferably in the range of $1\times10^{-4}$ to $1\times10^{-2}$ mol, more preferably $1\times10^{-3}$ to $5\times10^{-3}$ mol, per mol of host tabular grains.

With respect to the method of forming epitaxial portions, a solution containing halide ions and a solution containing $AgNO_3$ may be added simultaneously or separately. Alternatively, the formation may be effected by carrying out the addition in appropriate combination with, for example, the addition of AgCl fine grains, AgBr fine grains or AgI fine grains all having a grain diameter smaller than that of host tabular grains, or the addition of mixed crystal grains thereof. In the present invention, most preferable addition is that by the double jet method of a silver nitrate aqueous solution and an aqueous solution containing bromide salt and chloride salt, together with the addition, immediately before the double jet addition or at the same time with the double jet addition, of the above-mentioned silver iodide fine grain emulsion that was prepared immediately before the addition thererof. This method enables free control of the silver iodide content in the epitaxial junction portion, and also enables homogeneous distribution of the silver iodide content in the epitaxial junction portion between grains. The preparation method for silver iodide fine grain emulsion prepared immediately before the addition is fundamentally the same as that mentioned above. When the $AgNO_3$ solution is added, the addition time is preferably in the range of 30 sec to 10 min, more preferably 1 to 5 min. For the formation of the epitaxial tabular grains of the present invention, the concentration of added silver nitrate solution is preferably 1.5 mol/L or less, more preferably 0.5 mol/L or less. At that time, the agitation of the system must be carried out efficiently, and, with respect to the viscosity of the system, the lower, the more preferable.

The silver amount in the epitaxial junction portion(s) is preferably 0.5 mol % or more and 10 mol % or less, more preferably, 1 mol % or more and 5 mol % or less, with respect to the silver amount of the host tabular grain. When the silver amount in the epitaxial junction portion(s) is too small, preparation of the epitaxial emulsion cannot be carried out, and when the silver amount is too large, the epitaxial emulsion becomes unstable.

The pBr during the formation of the epitaxial portion is preferably 3.5 or more, and especially preferably 4.0 or more. The epitaxial formation is preferably conducted at a temperature preferably in a range from 35° C. to 45° C. During this formation of the epitaxial junction portion, a hexa-cyano metal complex is preferably doped in the portion.

Among the hexa-cyano metal complex, those containing iron, ruthenium, osmium, cobalt, rhodium, iridium or chromium are preferable. The addition amount of the metal salt is preferably within the range of $10^{-9}$ to $10^{-2}$ per mol of silver halide, and more preferably within the range of $10^{-8}$ to $10^{-4}$. The metal complex may be added by dissolving it to water or a organic solvent. The organic solvent is preferably miscible with water. As examples of the organic solvent, alcohols, ethers, glycols, ketons, esters, and amides are included.

As the metal complexes, hexa-cyanometal complexes represented by the following formula (I) is especially preferable. The hexa-cyano metal complex provides advantages of attaining high-sensitive lightsensitive material, and suppressing fogging from arising even when a photosensitive material is stored for a long period of time.

$$[M(CN)_6]^{n-} \quad \text{(I)}$$

wherein M represents iron, ruthenium, osmium, cobalt, rhodium, iridium or chromium, and n represent 3 or 4.

Specific examples of the hexa-cyano metal complexes are set forth below:

| | |
|---|---|
| (I-1) | $[Fe(CN)_6]^{4-}$ |
| (I-2) | $[Fe(CN)_6]^{3-}$ |
| (I-3) | $[Ru(CN)_6]^{4-}$ |
| (I-4) | $[Os(CN)_6]^{4-}$ |
| (I-5) | $[Co(CN)_6]^{3-}$ |
| (I-6) | $[Rh(CN)_6]^{3-}$ |
| (I-7) | $[Ir(CN)_6]^{3-}$ |
| (I-8) | $[Cr(CN)_6]^{4-}$ |

For the counter cations of the hexa-cyano complex, those easily miscible with water, and suitable for precipitation procedure of a silver halide emulsion are preferably used. Examples of the counter ions includes alkali metal ions (e.g. sodium ion, potassium ion, rubidium ion, cesium ion and lithium ion), ammonium ion and alkylammonium ion.

The emulsion of the present invention is added with the afore mentioned sensitizing dye and/or an anti-foggant to be described later and/or a stabilizer after the epitaxial deposition.

After this, in the present invention, it is preferable to wash with water an emulsion. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

As a protective colloid into which the emulsion thus obtained is dispersed, gelatin is advantageously used. Most preferable gelatin is a high-molecular weight gelatin obtained by chemically cross-linking a conventional gelatin. The use of such high-molecular weight gelatin makes the epitaxial emulsion of the invention more stable. On the other hand, hydrophilic colloids other than the high-molecular weight gelatin can also be used.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole. Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

The emulsion of the present invention is preferably subjected to a chemical sensitization after washing and dispersion. One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the tellurium sensitization, labile tellurium compounds, such as those described in JP-A's-4-224595, 4-271341, 4-333043, 5-303157, 6-27573, 6-175258, 6-180478, 6-208184, 6-208186, 6-317867, 7-140579, 7-301879, and 7-301880.

Specifically, use can be made of phosphinetellurides (e.g., n-butyl diisopropylphosphinetelluride, tri-isobutylphosphinetelluride, tri-n-buthoxyphosphinetelluride, and triisopropylphosphinetelluride); diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, and bis(ethoxycarbonyl) telluride; telluroureas (e.g., N,N'-dimethylethylenetellurourea); telluroamides; and telluroesters. Preferably, phosphinetellurides and diacyl(di) tellurides may be used.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

Reduction sensitization is preferably performed during grain formation, after grain formation but before chemical sensitization, during chemical sensitization, or after chemical sensitization of the silver halide photographic emulsion. Herein, the reduction sensitization can be performed by selecting form a method of adding reduction sensitizers to the silver halide emulsion, a method of so called silver ripening in which growth or ripening is performed in a low pAg atmosphere of pAg of 1–7, and a method of so called silver ripening in which growth or ripening is performed in a high pH atmosphere of pH of 8–11. A combination of two or more methods can be selected.

The method of adding reduction sensitizer is preferable in a view point that reduction sensitization level can be finely controlled.

As the reduction sensitizer stannous chloride, ascorbic acid and its derivatives, amines and polyamines, hydrazine derivatives, formamidinesulfinic acid, a silane compound, and a borane compound, are known. In reduction sensitization of the present invention, it is possible to selectively use these reduction sensitizers or to use two or more types of compounds together. Preferable compounds as the reduction sensitizer are stannous chloride, thiourea dioxide, dimethylamineborane, ascorbic acid and its derivatives. Although the addition amount of reduction sensitizers must be so selected as to meet the emulsion manufacturing conditions, a proper amount is $10^{-7}$ to $10^{-3}$ mol per mol of a silver halide.

The reduction sensitizer is added during grain formation by dissolving thereof to water, or organic solvents such as alcohols, glycols, ketones, esters, and amides. The reduction sensitizer may be pre-added to a reaction vessel, but the method of adding a reduction sensitizer at a proper period during grain formation is preferable. Further, a reduction sensitizer may be pre-added to an aqueous silver salt solution or an aqueous alkali halide solution, thereby silver halide is made to precipitate by using these solutions. Further, it is also a preferable method that a solution of a reduction sensitizer is added separately for some times or continuously for a long time, together with grain growth.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones. The combined use of the above-mentioned reduction sensitizer and an oxidizer to silver is preferable embodiment. A selection from a method of performing the reduction sensitization after using the oxidizer, a method of vice versa, or the method of simultaneously co-existing both of the methods, can be made.

The silver halide photographic material prepared using the silver halide emulsion obtained in the invention may be provided with at least one lightsensitive emulsion layer on a support. Preferably, the photographic material is provided with at least one blue-sensitive layer, at least one green-sensitive layer, and at least one red-sensitive layer on a support. There is no particular limitation of the number and arrangement order of the silver halide emulsion layer and non-light sensitive emulsion layer. A typical example is a silver halide photographic lightsensitive material having at least one lightsensitive unit layer comprising a plural of silver halide emulsion layers having substantially the same color sensitivity but different in speeds, on a support. The unit lightsensitive layer is that having sensitivity to any one of blue light, green light and red light. In a multi-layered silver halide color photographic lightsensitive material, the arrangement of the unit lightsensitive layers is generally in the order of a red-sensitive layer unit, a green-sensitive layer unit, and blue-sensitive layer unit from the side closer to the support. However, the order may be reversed depending on the purpose of the photographic material. Further, a different lightsensitive layer may be interposed between the same color sensitive layers.

A non-lightsensitive layer can be formed between the silver halide lightsensitive layers.

These intermediate layers may contain DIR compounds and couplers such as those described in JP-A's-61-43748, 59-113438, 59-113440, 61-20037, and 61-20038, and may contain a color-mixing inhibitor as conventionally used.

A plural of silver halide emulsion layer constituting the unit lightsensitive layer may be a two-layered structure of high- and low-speed emulsion layers as described in DE (German Patent) 1,121,470 or GB 923,045. Usually the layers are so arranged that the sensitivity to light becomes sequentially lower toward the support. Also, as described in JP-A's-57-112751, 62-200350, 62-206541 and 62-206543 layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932 layers can be arranged from the farthest side from a support in the order of blue-sensitive layer/GH/RH/GL/RL.

Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted.

The preferable layer in which the emulsion of the present invention is used, is a medium-speed emulsion layer and low-speed emulsion layer, and more preferably a low-speed emulsion layer. Silver amount of the emulsion used in each emulsion layer is 0.3 to 3 g/m$^2$, preferably 0.5 to 2 g/m$^2$, in terms of silver atom weight.

Furthermore, the arrangement can be changed as described above even when four or more layers are formed.

In the lightsensitive material of the invention above-mentioned various additives may be used, and other additive may also be used in conformity with the object.

These additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical -sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, and stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |
| 10 | Binders | page 26 | page 651, left column | page 1003, right column to page 1004, right column |
| 11 | Plasticizers, lubricants | page 27 | page 650, right column | page 1006, left to right columns |

-continued

| | Types of additives | RD17643 | RD18716 | RD308119 |
|---|---|---|---|---|
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couples may be used in the present invention, and the specific examples thereof are described in the patents described in the patents described in the aforementioned Research Disclosure No. 17643, VII-C to G and No. 307105, VII-C to G, all the disclosures of which are incorporated herein by reference.

Preferred yellow couplers are those described in, for example, U.S. Pat. Nos. 3,933,051, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649, and European Patent No. 249,473A.

Particularly preferred magenta couplers are 5-pyrazolone and pyrazoloazole compounds. Particularly preferred are those described in U.S. Pat. Nos. 4,310,619 and 4,351,897, European Patent No. 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Particularly preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329,729, European Patent Nos. 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, U.S. Pat. Nos. 3,451,820, 4,080,211, 4,367,282, 4,409,320 and 4,576,910, British Patent No. 2,102,137 and European Patent No. 341,188A.

The couplers capable of forming a colored dye having a suitable diffusibility are preferably those described in U.S. Pat. No. 4,366,237, British Patent No. 2,125,570, European Patent No. 96,570 and West German Patent (Publication) No. 3,234,533.

Colored couplers used for compensation for unnecessary absorption of the colored dye are preferably those described in Research Disclosure No. 17643, VII-G and No. 307105, VII-G, U.S. Pat. No. 4,163,670, JP-B-57-39413, U.S. Pat. Nos. 4,004,929 and 4,138,258 and British Patent No. 1,146,368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in U.S. Pat. No. 4,777,120.

Further, compounds which release a photo-graphically useful residue during a coupling reaction are also preferably usable in the present invention. DIR couplers which release a development inhibitor are preferably those described in the patents shown in the above described RD 17643, VII-F and No. 307105, VII-F as well as those descried in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in British Patent Nos. 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidate of a developing agent as described in JP-A's-60-107029, 60-252340, 1-44940 and 1-45687 are also preferred.

Other compounds usable for the photosensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in European Patent Nos. 173,302 A and 313,308 A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

The couplers used in the present invention can be incorporated into the photosensitive material by various known dispersion methods.

High-boiling solvents used for an oil-in-water dispersion method are described in, for example, U.S. Pat. No. 2,322,027.

The high-boiling organic solvents having a boiling point under atmospheric pressure of at least 175° C. and usable in the oil-in-water dispersion method include, for example, phthalates (such as dibutyl phthalate, dicyclohexyl phthalate, di-2-ethylhexyl phthalate, decylphthalate, bis(2, 4-di-t-amylphenyl) phthalate, bis(2,4-di-t-amylphenyl) isophthalate and bis(1,1-diethylpropyl)phthalate), phosphates and phosphonates (such as triphenyl phosphate, tricresyl phosphate, 2-ethylhexyldihenyl phosphate, tricyclohexyl phosphate, tri-2-ethylhexyl phosphate, tridodecyl phoshate, tributoxyethyl phosphate, trichloropropyl phosphate and di-2-ethylhexylphenyl phosphate), benzoates (such as 2-ethylhexyl benzoate, dodecyl benzoate and 2-ethylhexyl-p-hydroxybenzoate), amides (such as N,N-di ethyldodecaneamide, N,N-diethyllaurylamide and N-tetradecylpyrrolidone), alcohols and phenols (such as isostearyl alcohol and 2,4-di-tert-amylphenol), aliphatic carboxylates (such as bis(2-ethylhexyl) sebacate, dioctyl azelate, glycerol tributyrate, isostearyl lactate and trioctyl citrate), aniline derivatives [such as N,N-dibutyl-2-butoxy-5-tert-octylaniline] and hydrocarbons (such as paraffin, dodecylbenzene and diisopropylnaphthalene). Co-solvents usable in the present invention include, for example, organic solvents having a boiling point of at least about 30° C., preferably 50 to about 160° C. Typical examples of them include ethyl acetate, butyl acetate, ethyl propionate, methyl ethyl ketone, cyclohexanone, 2-ethoxyethyl acetate and dimethylformamide.

The steps and effects of the latex dispersion method and examples of the latices usable for the impregnation are described in, for example, U.S. Pat. No. 4,199,363 and West German Patent Application (OLS) Nos. 2,541,274 and 2,541,230.

The color photosensitive material used in the present invention preferably contains phenethyl alcohol or an antiseptic or mold-proofing agent described in JP-A's-63-257747, 62-272248 and 1-80941 such as 1,2-benzoisothiazolin-3-one, n-butyl p-hydroxybenzoate, phenol, 4-chloro-3,5-dimethylphenol, 2-phenoxyethanol or 2-(4-thiazolyl) benzimidazole.

The present invention is applicable to various color photosensitive materials such as ordinary color negative films, cinema color negative films, reversal color films for slides or televisions, color papers, positive color films and reversal color papers. The present invention is especially preferably applied to also a color dupe film.

Suitable supports usable in the present invention are described, for example, on page 28 of the above-described RD. No. 17643, from right column, page 647 to left column, page 648 of RD. No. 18716 and on page 879 of RD. No. 307105.

The photosensitive material of the present invention has a total thickness of the hydrophilic colloidal layers on the emulsion layer-side of 28 μm or below, preferably 23 μm or below, more preferably 18 μm or below and particularly 16 μm or below. The film-swelling rate $T_{1/2}$ is preferably 30 sec or below, more preferably 20 sec or below. The thickness is determined at 25° C. and at a relative humidity of 55% (2 days). The film-swelling rate $T_{1/2}$ can be determined by a method known in this technical field. For example, it can be determined with a swellometer described on pages 124 to 129 of A. Green et al., "Photogr. Sci. Eng.", Vol. 19, No. 2. $T_{1/2}$ is defined to be the time required for attaining the thickness of a half (½) of the saturated film thickness (the saturated film thickness being 90% of the maximum thickness of the film swollen with the color developer at 30° C. for 3 minute 15 seconds)

The film-swelling rate $T_{1/2}$ can be controlled by adding a hardener to gelatin used as the binder or by varying the time conditions after the coating.

The photosensitive material used in the present invention preferably has a hydrophilic colloid layer (in other words, back layer) having total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid, surfactant, etc. The swelling rate of the back layer is preferably 150 to 500%.

The color photographic lightsensitive material according to the present invention may be developed by a conventional method described in aforementioned RD. No. 17643, pages 28 to 29, ditto No. 18716, page 651, left to right columns, and ditto No. 30705, pages 880 to 881.

The color developer to be used in the development of the light-sensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds are 3-methyl-4-amino-N-ethyl-N-β-hydroxyethylaniline sulfate. These compounds can be used in combination of two or more thereof depending on the purpose of application.

The color developer normally contains a pH buffer such as carbonate, borate and phosphate of an alkali metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof).

Further, when reversal processing is to be performed on the photographic material, color development is usually performed after black-and-white development. As the black-and-white developer, known black-and-white developers can be used singly or in combination, which include dihydroxybenzenes, such as hydroquinone, 3-pyrazolidones, such as 1-phenyl-3-pyrazolidone, or aminophenols, such as N-methyl-p-aminophenol. Theses black-and-white developers usually have a pH of from 9 to 12. The replenishment rate of the developer is usually 3 liter (hereinafter liter is also referred to as "L") or less per $m^2$ of the light-sensitive material, though depending on the type of the color photographic material to be processed. The replenishment rate may be reduced to 500 milliliter/$m^2$ or less by decreasing the bromide ion concentration in the replenisher (hereinafter milliliter is also referred to as "mL"). If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

$$\text{Opening rate}=[\text{ area of processing solution in contact with air } (cm^2)/[\text{volume of processing solution } (cm^3)]$$

The opening rate as defined above is preferably in the range of 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably effected in both color development and black-and-white development steps as well as all the subsequent steps such as bleach, blix, fixing, washing and stabilization. The replenishment rate can also be reduced by a means for suppressing accumulation of the bromide ion in the developing solution.

The period for the color development processing usually sets between 2 to 5 min, the processing time can be shortened further by setting high pH and temperature, and using high concentration color developer.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of potyvalent metals, e.g., iron (III), peroxides, quinones, and nitro compounds. Typical examples of these bleaching agents are organic complex salts of iron (III) with, e.g., aminopolycarboxylic acids such as ethylenediaminetetraacetic acid, diethylenetriaminepentaacetic acid, cyclohexanediaminetetraacetic acid, methyliminodiacetic acrid, 1,3-diaminopropanetetraacetic acid and glycol ether diaminetetraacetic acid, or citric acid, tartaric acid, malic acid, etc. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or blix solution comprising such an antinopolycarboxylic acid-iron (III) complex salts is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812 and 2,059,988, JP-A's-53-32736, 53-57831, 53-37418, 53-72623, 53-95630, 53-95631, 53-104232, 53-124424, 53-141623, and 53-28426 and Research Disclosure No. 17129 (July 1978), thiazolidine derivatives as described in JP-A-51-140129, thiourea derivatives as described in JP-B-45-8506, JP-A's-52-20832, and 53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A's-49-40943, 49-59644, 53-94927, 54-35727, 55-26506 and 58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

In the present invention, compounds having pKa of 6.0 to 9.0 are preferably added to the fixing solution or a bleach-fixing solution in order to pH adjustment. Preferablly, imidazoles such as imidazole, 1-methylimidazole, 1-ethylimidazole, and 2-methylimidazole are added in an amount of 0.1 to 10 mol/L.

The total time required for desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic material of the present invention are subjected to washing and/or stabilization. The quantity of water to be used in the washing can be selected from a broad range depending on the characteristics of the light-sensitive material (for example, the kind of materials such as couplers, etc.), the end use of the light-sensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248–253 (May 1955).

According to the multi-stage counter-current system described in the above reference, although the requisite amount of water can be greatly reduced, bacteria would grow due to an increase of the retention time of water in the tank, and floating masses of bacteria stick to the light-sensitive material. In the processing for the color light-sensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyogijutsukai, (1982), and Nippon Bokin Bobi Gakkai (ed.), "Bokin bobizai jiten" (1986).

The washing water has a pH value of from 4 to 9, preferably from 5 to 8 in the processing for the light-sensitive material of the present invention. The temperature of the water and the washing time can be selected from broad ranges depending on the characteristics and end use of the light-sensitive material, but usually ranges from 15° C. to 45° C. in temperature and from 20 seconds to 10 minutes in time, preferably from 25° C. to 45° C. in temperature and from 30 seconds to 5 minutes in time. The light-sensitive material of the present invention may be directly processed with a stabilizer in place of the washing step. For the stabilization, any of the known techniques as described in JP-A's-57-8543, 58-14834 and 60-220345 can be used.

The aforesaid washing step may be followed by stabilization in some cases. For example, a stabilizing bath containing a dye stabilizer and a surface active agent as is used as a final bath for color light-sensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration is preferably corrected for by the addition of water.

The silver halide color light-sensitive material of the present invention may contain a color developing agent for the purpose of simplifying and expediting processing. Such a color developing agent is preferably used in the form of various precursors, when it is contained in the light-sensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The automatic developing machine to be used in the processing of the light-sensitive material of the present invention is preferably equipped with a light-sensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic material of the present invention are subjected to washing and/or stabilization. The quantity of water to be used in the washing can be selected from a broad range depending on the characteristics of the light-sensitive material (for example, the kind of materials such as couplers, etc.), the end use of the light-sensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248–253 (May 1955).

According to the multi-stage counter-current system described in the above reference, although the requisite amount of water can be greatly reduced, bacteria would grow due to an increase of the retention time of water in the tank, and floating masses of bacteria stick to the light-sensitive material. In the processing for the color light-sensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyogijutsukai, (1982), and Nippon Bokin Bobi Gakkai (ed.), "Bokin bobizai jiten" (1986).

The washing water has a pH value of from 4 to 9, preferably from 5 to 8 in the processing for the lightsensitive material of the present invention. The temperature of the water and the washing time can be selected from broad ranges depending on the characteristics and end use of the light-sensitive material, but usually ranges from 15° C. to 45° C. in temperature and from 20 seconds to 10 minutes in time, preferably from 25° C. to 45° C. in temperature and from 30 seconds to 5 minutes in time. The light-sensitive material of the present invention may be directly processed with a stabilizer in place of the washing step. For the stabilization, any of the known techniques as described in JP-A's-57-8543, 58-14834 and 60-220345 can be used.

The aforesaid washing step may be followed by stabilization in some cases. For example, a stabilizing bath containing a dye stabilizer and a surface active agent as is used as a final bath for color light-sensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration is preferably corrected for by the addition of water.

The silver halide color light-sensitive material of the present invention may contain a color developing agent for the purpose of simplifying and expediting processing. Such a color developing agent is preferably used in the form of various precursors, when it is contained in the light-sensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A's-56-64339, 57-144547 and 58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide lightsensitive material of the invention may be applied to heat-development lightsensitive material as described, for example, in U.S. Pat. No. 4,500,626, and JP-A's-60-133449, 59-218443 and 61-238056, and European Patent 210 660A2.

Further, the silver halide color photographic lightsensitive material of the invention can exhibit advantages easily when it is applied to lens-fitted film unit described, for example, in Jap. Utility Model KOKOKU Publication Nos. 2-32615 and 3-39784, which is effective.

EXAMPLE

The present invention will be specifically described by examples below. However, the present invention is not limited to there examples.

Example-1

The effects of the content of the silver chloride in epitaxial junction portions and the ratio of (111) faces in side surfaces of tabular grains in the present invention will be described.

(Preparation of Emulsion a)

1,500 mL of an aqueous solution containing 4.1 g of KBr and 7.1 g of gelatin with an average molecular weight of 20,000 and having been adjusted the pH thereof to 4 was stirred while being maintained at 40° C. An aqueous solution containing $AgNO_3$ (8.4 g) and an aqueous solution containing halogen (containing 5.9 g of KBr and 1.1 g of KI) were added over 40 seconds by the double jet method. After 35.5 g of succinated gelatin with an average molecular weight of 100,000 was added, the pH was adjusted to 5 and then the temperature was raised to 58° C. After an aqueous solution of $AgNO_3$ (2.4 g) was added over 2 minutes, 59 mL of a 6.25 mol/L ammonium nitrate solution and 59 mL of a 1N sodium hydroxide solution were added. After ripening for 12 minutes, the pH was adjusted to 5 again by addition of acetic acid. As a first growth, an aqueous solution of $AgNO_3$ (182.3 g) and an aqueous KBr solution were added by the double-jet method over 22 minutes while the flow rates were accelerated. During this addition, the silver potential was held at −20 mV with respect to a saturated calomel electrode. After that, as a second growth, an aqueous solution of $AgNO_3$ (21.5 g) and an aqueous solution containing 17 mol % of KI were added over 5 minutes by the double jet method. During this addition, the silver potential with respect to a saturated calomel electrode was held at 20 mV for the first 3 minutes and thereafter at 85 mV. Through the above-mentioned operations, host tabular grains to which epitaxial deposition has not been deposited were completed.

After decreasing the temperature to 38° C., 134 mg of benzimidazole was added to adjust the pH to 4.5. After addition of an aqueous KI (0.5 g) solution, sensitizing dyes I, II and III were added at a molar ratio of 6:3:1 in a ratio of 80% of the saturated covering amount. Note that the sensitizing dyes were used in the form of fine solid dispersions prepared by the method described in JP-A-11-52507. That is, 0.8 parts by weight of sodium nitrate and 3.2 parts by weight of sodium sulfate were dissolved in 43 parts by weight of ion exchange water. 13 parts by weight of the sensitizing dyes were added, and the resultant material was dispersed at 60° C. for 20 minutes by using a dissolver blade at 2,000 rpm, thereby obtaining a solid dispersion of the sensitizing dye. $8.0\times10^{-5}$ mol (hereinafter, per mole of silver in the host tabular grains) of potassium hexacyanoruthenate (II) was added. 100 mL of an aqueous $AgNO_3$ (9.2 g) solution and 100 mL of an aqueous halogen solution containing KBr (2.1 g) and NaCl (2.8 g) were added over one minute by the double jet method. The silver potential at the completion of the addition was +90 mV with respect to a saturated calomel electrode.

After addition of $1\times10^{-4}$ mol of an antifoggant I, the emulsion was washed with water at 35° C. according to the conventional method, and subsequently, deionized gelatin with an average molecular weight of 100,000 was added to redisperse the emulsion at 40° C. to adjust the pH to 5.5. The resulting emulsion was heated to 50° C. and was subjected to optimal chemical sensitization by addition of potassium thiocyanate, chloroauric acid, sodium thiosulfate and N,N-dimethylselenourea. The chemical sensitization was terminated by addition of $5\times10^{-4}$ mol of an antifoggant I. The resulting emulsion was referred to as Emulsion a.

Emulsion a had an average equivalent-circle diameter of 0.82 μm, a variation coefficient of equivalent-circle diameter of 18%, an average thickness of 0.065 μm, a variation coefficient of thickness of 17%, and an average aspect ratio of 12.6. 90% or more of the total projected area was occupied by hexagonal tabular grains having an equivalent-circle diameter of 0.7 μm or more, a thickness of 0.075 μm and a ratio of the length of a side with a maximum length to the length of a side with a minimum length of 1.4 or less. Electron microscopic observation of a section of a grain showed that the average twin face spacing was 0.010 μm and that the variation coefficient of twin face spacing was 19%. In transmission electron microscopic observation at low temperature, in the region of 90% or more of the total projected area, no dislocation lines were observed in the portion other than epitaxial junction portions. In the emulsion, the silver iodide content in the host tabular grains was 1.75 mol %. The silver amount in the epitaxial junction portions was 4.29 mol % with respect to the host tabular grains and 4.11 mol % with respect to the total silver.

Sensitizing dye I

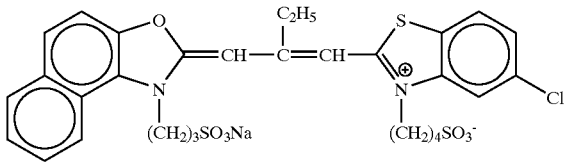

Sensitizing dye II

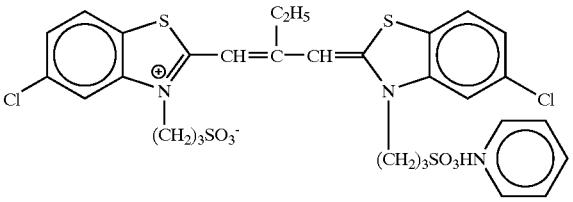

Sensitizing dye III

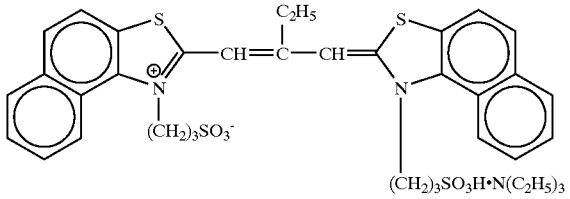

Antifoggant

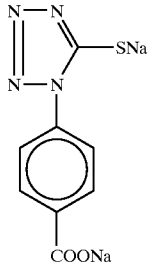

(Preparation of Emulsions b, c, d, e and f)

Emulsions b, c, d, e and f were prepared by changing the amounts of KBr and NaCl in the aqueous halogen solution used for the epitaxial deposition in the preparation of Emulsion a.

(Preparation of Emulsions g, h, i, j and k)

Emulsion g was prepared by changing the second growth of Emulsion a as follows. As the second growth, an aqueous solution of $AgNO_3$ (21.5 g) and an aqueous KBr solution were added over 5 minutes by the double jet method. During this addition, the silver potential with respect to a saturated calomel electrode was held at 20 mV for the first 3 minutes and thereafter at 85 mV. During this 5-minute growth, an AgI fine grain emulsion prepared immediately prior to its addition was simultaneously added so that the silver iodide content became 17 mol %. The AgI fine grain emulsion was prepared by adding at 25° C. an aqueous solution containing 1.913% by weight of $AgNO_3$ and an aqueous solution containing 1.92% by weight of KI and 1.9% by weight of gelatin with an average molecular weight of 20,000 using an agitator described in the description of the present invention. This emulsion was added 5 seconds after its preparation. The AgI fine grains had an average grain size of 0.0088 μm and the variation coefficient of grain size distribution was 24%. Similar changes were effected to Emulsions b, c, d and e, thereby obtaining Emulsions h, i, j and k. Emulsions g-2, h-2, i-2, j-2 and k-2 were prepared by adding a previously prepared silver iodide fine grain emulsion in place of the silver iodide fine grains that were prepared immediately before its addition and that were used in the preparation of Emulsions g to k. The previously prepared silver iodide fine grain emulsion had an average grain size of 0.03 μm and a variation coefficient of grains size of 14%. However, in all the cases, the silver iodide fine grain emulsions remained undissolved, making it impossible to conduct evaluation of photographic characteristics of Emulsions g-2, h-2, i-2, j-2 and k-2.

(Preparation of Emulsions 1, m and n)

Emulsion 1 was prepared by changing the second growth of Emulsion d as follows. The silver potential during the 5-minute double jet addition was held at 20 mV for the first 3 minutes and thereafter at 40 mV. Emulsions m and n were prepared by changing the silver potential from 40 mV to 0 mV and −20 mV, respectively.

(Preparation of Emulsions o, p and q)

Emulsion o was prepared by changing the second growth of Emulsion j as follows. The silver potential during the 5-minute double jet addition was held at 20 mV for the first 3 minutes and thereafter at 40 mV. Emulsions p and q were prepared by changing the silver potential from 40 mV to 0 mV and −20 mV, respectively.

The characteristics of Emulsions a to q are summarized in Table 1. Deposition in epitaxial portions was determined from electron microscopic observation by the replica method, the compositions of the epitaxial portions were determined with an analytic electron microscope equipped with a field emission type electron gun, and the ratio of (111) faces in side surfaces was determined by a method using dye adsorption described in the text of this specification. In every case, both intragrain and intergrain variation coefficients of silver chloride content distribution in epitaxial portions were within 20%. The characteristics of the emulsions other than those shown in Table 1 were basically the same as those of Emulsion a.

TABLE 1

| Emulsion | Ratio (%) of grains having epitaxial junction on at least one apex portion (in terms of projected area) | Silver chloride content in epitaxial junction portion (mol %) | Ratio (%) of (111) face in side surfaces |
|---|---|---|---|
| a (Comp.) | 90 | 68 | 70 |
| b (Comp.) | 90 | 57 | 70 |
| c (Comp.) | 90 | 48 | 70 |
| d (Inv.) | 90 | 20 | 70 |
| e (Inv.) | 90 | 16 | 70 |
| f (Comp.) | 80 | 0 | 70 |
| g (Inv.) | 95 | 65 | 75 |
| h (Inv.) | 95 | 54 | 75 |
| i (Inv.) | 95 | 43 | 75 |
| j (Inv.) | 95 | 18 | 75 |
| k (Inv.) | 95 | 12 | 75 |
| 1 (Inv.) | 90 | 20 | 80 |
| m (Inv.) | 90 | 20 | 85 |
| n (Inv.) | 90 | 18 | 90 |
| o (Inv.) | 95 | 18 | 85 |
| p (Inv.) | 95 | 18 | 90 |
| q (Inv.) | 95 | 17 | 95 |

The results given in Table 1 clearly show that when host tabular grains are formed by addition of a silver iodobromide fine grain emulsion prepared immediately before its addition, the ratio of (111) faces in side surfaces of the tabular grains are increased and the ratio of grains having at least one epitaxial junction increases.

On cellulose triacetate film supports having thereon undercoat layers were formed protective layers to which the emulsions subjected to the above chemical sensitization were subsequently applied under coating conditions shown in Table 2. Thus, samples Nos. 1 to 17 were prepared.

TABLE 2

Emulsion coating condition (1) Emulsion layer
Emulsion . . . Each emulsion
(silver $2.1 \times 10^{-2}$ mol/m$^2$)
Coupler ($1.5 \times 10^{-3}$ mol/m$^2$)

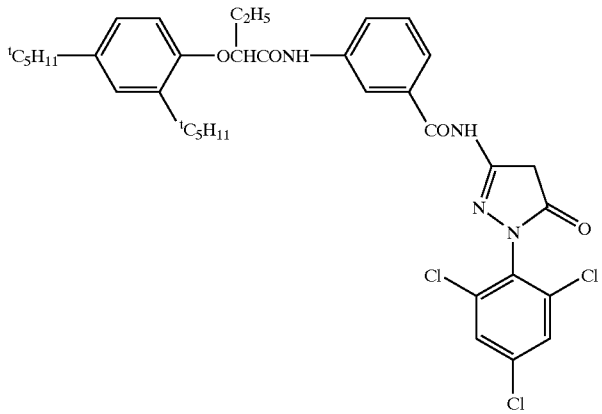

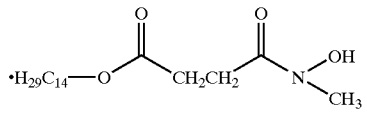

($1.1 \times 10^{-4}$ mol/m$^2$)
Tricresyl phosphate (1.10 g/m$^2$)
Gelatin (2.30 g/m$^2$)
(2) Protective layer
2,4-Dichloro-6-hydroxy-s-triazine sodium salt
(0.08 g/m$^2$)
Gelatin (1.80 g/m$^2$)

The samples were left to stand for 14 hours under the conditions of 40° C. and a relative humidity of 70%. Thereafter, the samples were exposed to light for 1/100 sec through a gelatin filter SC-50 manufactured by Fuji Photo Film Co., Ltd. and a continuous wedge.

The development was carried out by the use of automatic processor FP-360B manufactured by Fuji Photo Film Co., Ltd. under the following conditions (until the accumulated replenishing amount of the solution reaches three times the tank volume of the mother liquid).

(Processing steps)

| Step | Time | Temp. | Quantity of replenisher* |
|---|---|---|---|
| Color development | 3 min 15 sec | 38° C. | 45 mL |
| Bleaching | 1 min 00 sec | 38° C. | 20 mL Overflow of the bleaching solution was flowed into the bleach-fixing tank |
| Bleach-Fixing | 3 min 15 sec | 38° C. | 30 mL |
| Washing (1) | 40 sec | 35° C. | Counter current pipe Arrangement from (2) to (1) |
| Washing (2) | 1 min 00 sec | 35° C. | 30 mL |
| Stabilization | 40 sec | 38° C. | — |
| Drying | 1 min 15 sec | 55° C. | |

*The replenishment rate is a value per 1.1 m of a 35-mm wide lightsensitive material (equivalent to one 24 Ex. film).

The composition of each of the processing solutions was as follows.

| (Color Developer) | Tank Solution (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]2-Methyl-aniline sulfate | 4.5 | 5.5 |
| Water to make | 1.0 L | 1.0 L |
| pH (adjusted by potassium hydroxide and sulfuric acid) | 10.05 | 10.10 |
| (Bleaching Solution) Common to both tank solution and reprenisher | | |
| Ammonium ethylenediamine tetraacetato ferrate dihydrate | 120.0 | |
| Disodium ethylenediaminetetraacetic acid | 10.0 | |
| Ammonium bromide | 100.0 | |
| Ammonium nitrate | 10.0 | |
| Bleach accelerator $(CH_3)_2N—CH_2—CH_2—S—S—CH_2—CH_2—CH_2—N(CH_3)_2 \cdot 2HCl$ | 0.005 mole | |
| Aqueous ammonia | 15.0 mL | |
| Water to make | 1.0 L | |
| pH (adjusted by aqueous ammonia and nitric acid) | 6.3 | |

-continued

| (Bleach-Fixing Solution) | Tank Solution (g) | Replenisher (g) |
|---|---|---|
| Ammonium ethylenediamine tetraacetato ferrate dihydrate | 50.0 | — |
| Disodium ethylenediaminetetraacetic Acid | 5.0 | 2.0 |
| Sodium sulfite | 12.0 | 20.0 |
| Aqueous solution of ammonium thiosulfate (700 g/L) | 240.0 mL | 400.0 mL |
| Aqueous ammonia | 6.0 mL | — |
| Water to make | 1.0 L | 1.0 L |
| pH (adjusted by aqueous ammonia and acetic acid) | 7.2 | 7.3 |
| (Washing Water) Common to both tank solution and reprenisher | | |

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/L or less and then thereto 20 mg/L of sodium isocyanurate dichloride and 150 mg/L of sodium sulfate were added. The resulting solution had a pH of from 6.5 to 7.5.

| (Stabilizing Solution) Common to both tank solution and reprenisher | (unit: g) |
|---|---|
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 L |
| PH | 8.5 |

The density of each processed sample was measured through a green filter. Also, development progression was evaluated by changing the color development time from 3 min 15 sec to 1 min 15 sec.

From those obtained above, fog value, and the sensitivities at the density of fog plus 0.2 and the density of 2.0, are set forth in Table 3.

TABLE 3

| | | Processing time 3 min 15 sec | | Processing time 1 min 15 sec | |
|---|---|---|---|---|---|
| Sample No. | Emulsion | Fog | Sensitivity (fog + 0.2) | Fog | Sensitivity (fog + 2.0) |
| 1 (Comp.) | a | 0.38 | 100 | 0.16 | 100 |
| 2 (Comp.) | b | 0.36 | 103 | 0.15 | 103 |
| 3 (Comp.) | c | 0.35 | 109 | 0.15 | 115 |
| 4 (Inv.) | d | 0.28 | 124 | 0.13 | 143 |
| 5 (Inv.) | e | 0.25 | 128 | 0.13 | 152 |
| 6 (Comp.) | f | 0.19 | 84 | 0.09 | 67 |
| 7 (Inv.) | g | 0.32 | 109 | 0.14 | 115 |
| 8 (Inv.) | h | 0.31 | 114 | 0.14 | 122 |
| 9 (Inv.) | i | 0.30 | 117 | 0.13 | 128 |

TABLE 3-continued

| Sample No. | Emulsion | Processing time 3 min 15 sec Fog | Sensitivity (fog + 0.2) | Processing time 1 min 15 sec Fog | Sensitivity (fog + 2.0) |
|---|---|---|---|---|---|
| 10 (Inv.) | j | 0.25 | 139 | 0.10 | 158 |
| 11 (Inv.) | k | 0.23 | 148 | 0.10 | 166 |
| 12 (Inv.) | l | 0.28 | 124 | 0.13 | 143 |
| 13 (Inv.) | m | 0.27 | 128 | 0.12 | 143 |
| 14 (Inv.) | n | 0.25 | 128 | 0.11 | 152 |
| 15 (Inv.) | o | 0.25 | 139 | 0.11 | 158 |
| 16 (Inv.) | p | 0.22 | 154 | 0.10 | 166 |
| 17 (Inv.) | q | 0.20 | 154 | 0.09 | 170 |

As is clear from comparing Emulsions a to f shown in Table 3, it is shown that when the silver chloride content in epitaxial junction portions falls within the range of 5 mol % or more and 25 mol % or less, which is within the scope of the invention, the sensitivity/fogging ratio is excellent and the color density achieved in a short processing time is remarkably enhanced. From comparison between Emulsions a through e and Emulsions g through k, it is shown that, as in the foregoing case, if host tabular grains are formed by addition of a silver iodobromide fine grain emulsion prepared immediately before its addition and the ratio of (111) faces in side surfaces is high, the sensitivity/fogging ratio is excellent and the color density achieved in a short processing time is remarkably enhanced. From comparison of Emulsion d and Emulsions 1 through n, and comparison of Emulsion j and Emulsions o through q, it is shown that the advantage of the silver chloride content in epitaxial junctions of the present invention and the advantage of the ratio of (111) faces in side surfaces of tabular grains are synergistic.

Example-2

A description is given below on the advantage obtained by the use of the silver iodide content in epitaxial portions within the scope of the present invention, particularly on the advantage obtained by the addition of a silver iodobromide fine grain emulsion prepared immediately before its addition.

(Preparation of Emulsions r, s, t, u and v)

Emulsions r, s, t, u and v were prepared by changing the epitaxial junctions in Emulsions c, d, l, o and q in Example-1 as follows, respectively. After reducing the temperature to 38° C., 134 mg of benzimidazole was added to adjust the pH to 4.5. After addition of an aqueous KI (0.5 g) solution, sensitizing dyes I, II and III were added at a molar ratio of 6:3:1 in a ratio of 80% of the saturated covering amount. Note that the sensitizing dyes were used in the form of fine solid dispersions prepared by the method described in JP-A-11-52507. That is, 0.8 parts by weight of sodium nitrate and 3.2 parts by weight of sodium sulfate were dissolved in 43 parts by weight of ion exchange water. 13 parts by weight of the sensitizing dyes were added, and the resultant material was dispersed at 60° C. for 20 minutes by using a dissolver blade at 2,000 rpm, thereby obtaining a solid dispersion of the sensitizing dye. $8.0\times10^{-5}$ mol (hereinafter, per mole of silver in the host tabular grains) of potassium hexacyanoruthenate(II) was added. 100 mL of an aqueous $AgNO_3$ (9.2 g) solution and 100 mL of an aqueous halogen solution containing KBr (2.1 g) and NaCl (2.8 g) were added over one minute by the double jet method.

One minute before this double jet addition, an AgI fine grain emulsion was added, which was prepared immediately before its addition, in an amount of 7 mol % with respect to the amount of silver in epitaxial junction portions. The AgI fine grain emulsion was prepared by adding, at 25° C., an aqueous solution containing 1.913% by weight of $AgNO_3$ and an aqueous solution containing 1.92% by weight of KI and 1.9% by weight of gelatin with an average molecular weight of 20,000 using an agitator described in the description of the present invention. This fine grain emulsion was added to the reaction vessel, over 10 seconds, 5 seconds after its preparation. The AgI fine grains had the average grain size of 0.0088 $\mu$m and a variation coefficient of grain size distribution was 24%. The silver potential at the completion of the addition was +90 mV with respect to a saturated calomel electrode. After addition of $1\times10^{-4}$ mol of an antifoggant I, the emulsion was washed with water at 35° C. according to the conventional method, and subsequently, deionized gelatin with an average molecular weight of 100,000 was added to redisperse the emulsion at 40° C. to adjust the pH to 6.0. The resulting emulsion was heated to 50° C. and was subjected to optimal chemical sensitization by the addition of potassium thiocyanate, chloroauric acid, sodium thiosulfate and N,N-dimethylselenourea. The chemical sensitization was terminated by the addition of $5\times10^{-4}$ mol of an antifoggant I.

Emulsions w, x, y, z and z-2 were prepared by adding a silver iodide fine grain emulsion prepared in advance in place of the use of silver iodide fine grains prepared immediately before its addition used in the preparation of Emulsions r to v. The silver iodide fine grain emulsion prepared in advance had an average grain size of 0.03 $\mu$m and a variation coefficient of grains size of 14%. However, in all the cases, the silver iodide fine grain emulsions remained undissolved, making it impossible to conduct evaluation of the photographic characteristics of Emulsions w, x, y, z and z-2.

The characteristics of Emulsions r to v are summarized in Table 4. Deposition in epitaxial portions was determined from electron microscopic observation by the replica method, the compositions of the epitaxial portions were determined with an analytic electron microscope equipped with a field emission type electron gun, and the ratio of (111) faces in side surfaces was determined by a method using dye adsorption described in the text of this specification. In every case, the variation coefficients of silver chloride content distribution in epitaxial portions both within a grain and between grains were within 20%. The characteristics of the emulsions other than those shown in Table 4 were basically the same as those of Emulsion a.

TABLE 4

| Emulsion | Ratio (%) of grains having epitaxial junction on at least one apex portion (in terms of projected area) | Silver chloride content in epitaxial junction portion (mol %) | Silver iodide content in epitaxial junction portion (mol %) | Ratio (%) of (III) face in side surfaces |
|---|---|---|---|---|
| r (Comp.) | 85 | 43 | 5 | 70 |
| s (Inv.) | 85 | 19 | 5 | 70 |
| t (Inv.) | 85 | 18 | 5 | 80 |
| u (Inv.) | 95 | 18 | 5 | 85 |
| v (Inv.) | 95 | 16 | 5 | 95 |

The emulsions were coated in the same manner as in Example 1 and photographic properties were evaluated, which are set forth in Table 5 below.

TABLE 5

| | Processing time 3 min 15 sec | | Processing time 1 min 15 sec | |
|---|---|---|---|---|
| Emulsion | Fog | Sensitivity (fog + 0.2) | Fog | Sensitivity (fog + 2.0) |
| r (Comp.) | 0.34 | 114 | 0.14 | 121 |
| s (Inv.) | 0.26 | 131 | 0.12 | 158 |
| t (Inv.) | 0.26 | 131 | 0.12 | 158 |
| u (Inv.) | 0.22 | 151 | 0.10 | 180 |
| v (Inv.) | 0.18 | 167 | 0.08 | 197 |

As is apparent from the results in Table 5, by the addition of silver iodide fine grain emulsion prepared immediately before the addition thereof, the emulsion of the present invention provided with the epitaxial portion, showed low fog and high sensitivity. In addition, the color density in the case of short processing time is extremely high.

Example-3

The advantages of the emulsion of the invention exerted in a multi-layered color photographic lightsensitive material are set forth below.

Emulsions Em-A to Em-M were prepared by the following methods.

(Preparation Method of Em-A)

42.2L of an aqueous solution containing 31.7 g of low-molecular weight gelatin having a molecular weight of 15,000 and phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of a low-molecular weight gelatin having a molecular weight of 15,000 were added over 2 min by the double jet method. Immediately after the addition, 44.8 g of KBr were added. After that, the temperature was raised to 40° C., and ripened. After the completion of the ripening, 923 g of a gelatin having a molecular weight of 100,000 and phthalated with a phthalation ratio of 97% and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the silver potential was maintained at −60 mV against saturated calomel electrode. After washing with water, gelatin was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of phthalated gelatin whose phthalation ratio is 97% and 1.7 g of KBr was vigorously stirred at 75° C. After 9.9 g of the above-mentioned seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was maintained at −20 mV against a saturated calomel electrode. After 2 mg of sodium benzenethiosulfonate and 2 mg of thiourea dioxide were added, 328 mL of an aqueous solution containing 105.6 g of $AgNO_3$ and a KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added with an accelerated flow rate so that the iodide content became 27 mol %, and the silver potential was maintained at −30 mV against a calomel electrode.

121.3 mL of an aqueous solution containing 45.6 g of $AgNO_3$ and a KBr solution were added by the double jet method over 22 min. During the addition, the silver potential was maintained at +20 mV against a saturated calomel electrode. The temperature was raised to 82° C., followed by adjustment of the silver potential at −80 mV by an addition of KBr, the above-mentioned AgI fine grain emulsion was added in an amount of 6.33 g in terms of silver. Immediately after the addition, 206.2 mL of an aqueous solution containing 66.4 g of $AgNO_3$ was added over 16 min. The silver potential was maintained at −80 mV with a KBr solution for the initial period of the addition of 5 min. After washing with water, gelatin was added, and the pH and the pAg were adjusted to 5.8 and 8.7, respectively, at 40° C. After compounds 11 and 12 were added, temperature was raised to 60° C. After sensitizing dyes 11 and 12 were added, potassium thiocyanate, chloroauric acid, sodium thiosulfate, and N,N-dimethylselenourea were added to optimally perform chemical sensitization. At the end of this chemical sensitization, compounds 13 and 14 were added. "Optimal chemical sensitization" herein means that the addition amount of each of the sensitizing dyes and the compounds was $10^{-1}$ to $10^{-8}$ mol per mol of a silver halide.

Compound 11

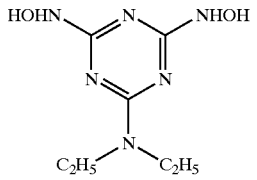

Compound 12

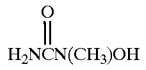

Sensitizing dye 11

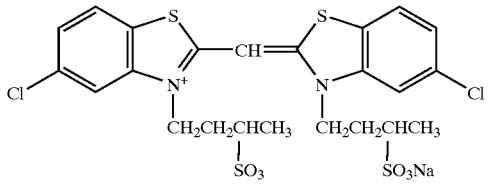

Sensitizing dye 12

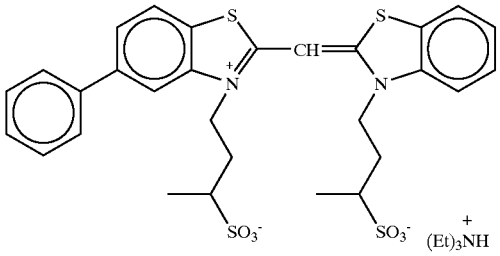

Compound 13

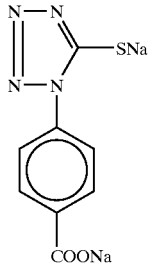

Compound 14

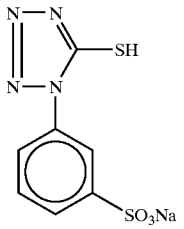

(Preparation Method of Em-B)

1,192 mL of an aqueous solution containing 0.96 g of a low-molecular weight gelatin and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of a trimellitated gelatin whose amino groups were modified with trimellitic acid and having a molecular weight of 100,000 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential against calomel electrode was maintained at −20 mV.

440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 15.8 mol %. At the same time, the silver potential was maintained at 0 mV. After 26 mg of sodium ethylthiosulfonate were added, the temperature was raised to 55° C., an aqueous KBr solution was added to adjust the silver potential at −90 mV. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the potential at the completion of the addition to +20 mV. The resultant emulsion was washed with water and chemically sensitized in substantially the same manner as for Em-A.

(Preparation Method of Em-C)

1,192 mL of an aqueous solution containing 1.02 g of phthalated gelatin containing 35 $\mu$mol of methionine per g thereof, and having a molecular weight of 100,000, and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of the trimellitated gelatin having a molecular weight of 100,000 and used in the preparation of Em-B, and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the silver potential against saturated calomel electrode was maintained at −30 mV. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 2.3 mol %. At the same time, the silver potential against saturated calomel electrode was maintained at −20 mV.

After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the silver potential was maintained at 10 mV. An aqueous KBr solution was added to adjust the silver potential at −70 mV. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the silver potential at the completion of the addition to −30 mV. The resultant emulsion was washed with water and chemically sensitized in substantially the same manner as for Em-A.

(Preparation Method of Em-D)

In the preparation of Em-C, the $AgNO_3$ addition amount during nucleation was increased by 2.3 times. Also, in the final addition of 404 mL of an aqueous solution containing 57 g of $AgNO_3$, the silver potential at the completion of the addition was changed to +90 mV by using an aqueous KBr solution. An emulsiong was prepared following substantially the same procedures as for Em-C except the foregoing.

(Preparation Method of Em-E)

1,200 mL of an aqueous solution containing 0.75 g of a low-molecular weight gelatin having a molecular weight of 15,000, 0.9 g of KBr, and 0.2 g of modified silicone oil used in the preparation of Em-A were held at 39° C. and stirred with violence at pH 1.8. An aqueous solution containing 0.45 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of a phthalated gelatin containing 35 μmol of methionine per g, having a molecular weight of 100,000 and phthalation ratio of 97% were added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, an AgI fine grain emulsion used in the preparation of Em-A was simultaneously added such that the silver iodide content was 4.1 mol %. At the same time, the silver potential against saturated calomel electrode was maintained at −60 mV.

After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the silver potential was maintained at −70 mV. After 1 mg of thiourea dioxide was added, 132 mL of an aqueous solution containing 41.8 g of $AgNO_3$ and an aqueous KBr solution were added over 25 min by the double jet method. The addition of the aqueous KBr solution was so adjusted that the potential at the completion of the addition was +20 mV. After 2 mg of sodium benzenthiosulfonate was added, the pH was adjusted to 7.3. The silver potential was adjusted to −70 mV by adding KBr., then 5.73 g, in terms of KI weight, of the above-mentioned AgI fine grain emulsion was added. Immediately after the completion of the addition, 609 mL of an aqueous solution containing 66.4 g of $AgNO_3$ were added over 10 min. For the first 6 min of the addition, the silver potential was maintained at −70 mV by an aqueous KBr solution.

After washing with water, gelatin was added, and the pH and the pAg were adjusted to 6.5 and 8.2, respectively at 40° C. After compounds 11 and 12 were added, the temperature was raised to 56° C. The above-mentioned AgI fine grain emulsion was added in an amount of 0.0004 mol per mol of silver halide, sensitizing dyes 13 and 14 were added. Chemical sensitization was optimally performed by adding potassium thiocyanate, chloroauric acid, sodium thiosulfate, and N,N-dimethylselenourea. At the completion of the chemical sensitization, compounds 13 and 14 were added.

Sensitizing dye 13

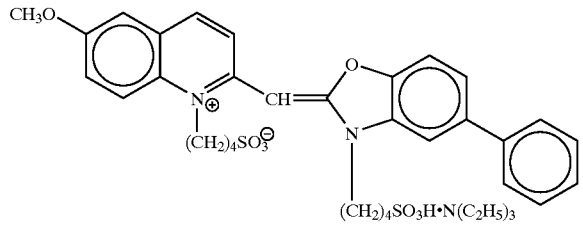

Sensitizing dye 14

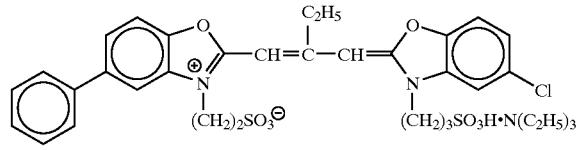

(Preparation Method of Em-F)

Em-F was prepared in almost the same manner as in Em-E, except that the $AgNO_3$ addition amount during nucleation was increased by 4.12 times. Further, the sensitizing dyes used in Em-E were changed to Sensitizing dyes 12, 15, 16 and 17.

Sensitizing dye 15

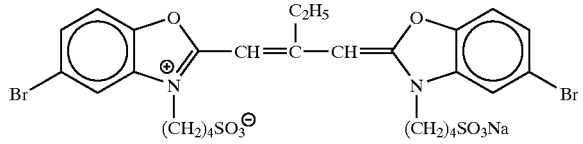

Sensitizing dye 16

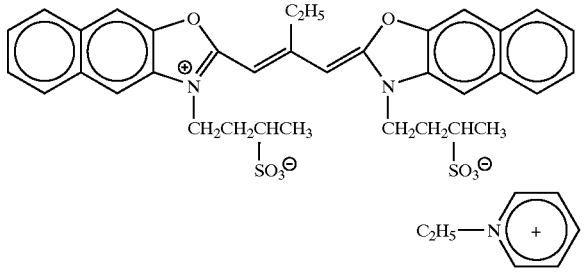

Sensitizing dye 17

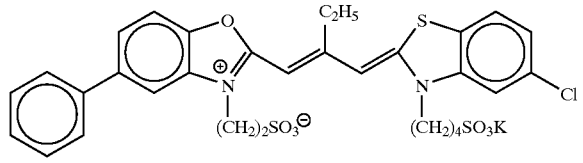

(Preparation Method of Em-G)

1,200 mL of an aqueous solution containing 0.70 g of a low-molecular weight gelatin having a molecular weight of 15,000, 0.9 g of KBr, and 0.2 g of modified silicone oil used in the preparation of Em-A were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of a trimellitated gelatin containing 35 μmol of methionine per g, and having a molecular weight of 100,000 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %, and the silver potential against saturated calomel electrode was maintained at −60 mV. The AgI fine grain emulsion was prepared immediately before the addition thereof by mixing a solution of low-molecular weight gelatin having a molecular weight of 15,000, an $AgNO_3$ solution and a KI solution in another chamber having a magnetic coupling inductive type stirring apparatus disclosed in JP-A-10-43570.

After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, abovementioned AgI fine grain emulsion prepared immediately before the addition by mixing the solutions, was simultaneously added such that the silver iodide content was 7.9 mol %. At the same time, the silver potential was maintained at −70 mV. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the potential at the completion of the addition was +20 mV. The temperature was raised to 78° C., and the pH was adjusted to 9.1, the silver potential was adjusted to −60 mV by adding KBr. Then 5.73 g, in terms of KI weight, of the AgI fine grain used in the preparation of Em-A was added. Immediately after the completion of the addition, 321 mL of an aqueous solution containing 66.4 g of $AgNO_3$ were added over 4 min. For the first 2 min of the addition, the silver potential was maintained at −60 mV by an aqueous KBr solution. The thus prepared emulsion was washed with water and chemically sensitized in almost the same manner as in Em-F.

(Preparation Method of Em-H)

An aqueous solution containing 17.8 g of an ion-exchanged gelatin having a molecular weight of 100,000, 6.2 g of KBr, and 0.46 g of KI were held at 45° C. and vigorously stirred. An aqueous solution containing 11.85 g of $AgNO_3$ and an aqueous solution containing 3.8 g of KBr were added over 45 sec by the double jet method. After the temperature was raised to 63° C., 24.1 g of an ion-exchanged gelatin having a molecular weight of 100,000 was added, and ripened. After the completion of the ripening, an aqueous solution containing 133.4 g of $AgNO_3$ and an aqueous KBr solution were added by the double jet method over 20 min so that the final flow rate is 2.6 times the initial flow rate. During the addition, the silver potential against saturated calomel electrode was maintained at +40 mV. Further, 10 min after the initiation of the addition, 0.1 mg of $K_2KrCl_6$ were added.

After 7 g of NaCl were added, an aqueous solution containing 45.6 g of $AgNO_3$ and an aqueous KBr solution were added over 12 min by the double jet method. During the addition, the silver potential was maintained at +90 mV. Also, over 6 min from the initiation of the addition, 100 mL of an aqueous solution containing 29 mg of yellow prussiate were added over 6 min. After 14.4 g of KBr were added, the AgI fine grain emulsion used in the preparation of Em-A was added in an amount of 6.3 g in terms of a KI weight. Immediately after the addition, an aqueous solution containing 42.7 g of $AgNO_3$ and an aqueous KBr solution were added over 11 min by the double jet method. During the addition, the silver potential was maintained at +90 mV. The thus prepared emulsion was washed with water and chemically sensitized in almost the same manner as in Em-F.

(Preparation Method of Em-I)

Em-I was prepared in almost the same manner as Em-H, except that the temperature during nucleation was changed to 35° C.

(Preparation Method of Em-J)

1,200 mL of an aqueous solution containing 0.38 g of phthalated gelatin having a molecular weight of 100,000 and a phthalation ratio of 97%, and 0.9 g of KBr were held at 60° C. and vigorously stirred at pH 2. An aqueous solution containing 1.96 g of $AgNO_3$ and an aqueous solution containing 1.67 g of KBr and 0.172 g of KI were added over 30 sec by the double jet method. After ripening, 12.8 g of a trimellitated gelatin whose amino groups were chemically modified with trimellitic acid, containing 35 $\mu$mol of methionine per g, and having a molecular weight of 100,000 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 31 min by the double jet method. During the addition, the silver potential against saturated calomel electrodes was maintained at −50 mV. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine grain emulsion used in the preparation of Em-A was simultaneously added at an accelerated flow rate such that the silver iodide content was 6.5 mol %. At the same time, the silver potential was maintained at −50 mV.

After 1.5 mg of thiourea dioxide were added, 132 mL of an aqueous solution containing 41.8 g and an aqueous KBr solution were added over 13 min by the double jet method. The addition of the aqueous KBr solution was so adjusted that the silver potential at the completion of the addition was +40 mV. After 2 mg of sodium benzenethiosulfonate were added, KBr was added to adjust the silver potential at −100 mV. The abovementioned AgI fine grain emulsion was added in an amount of 6.2 g in terms of a KI weight. Immediately after the addition, 300 mL of an aqueous solution containing 88.5 g of $AgNO_3$ were added over 8 min. An aqueous KBr solution was added to adjust the silver potential at the completion of the addition at +60 mV. After washing with water, gelatin was added, the pH and the pAg were adjusted to 6.5 and 8.2, respectively. After compounds 11 and 12 was added, the temperature was raised to 61° C. The sensitizing dyes 18, 19, 20 and 21 were added. After that, $K_2IrCl_6$, potassium thiocyanate, chloroauric acid, sodium thiosulfate, and N,N-dimethylselenourea were added to optimally perform chemical sensitization. At the end of the chemical sensitization, compounds 13 and 14 were added.

Sensitizing dye 18

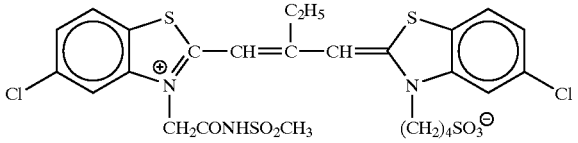

-continued

Sensitizing dye 19

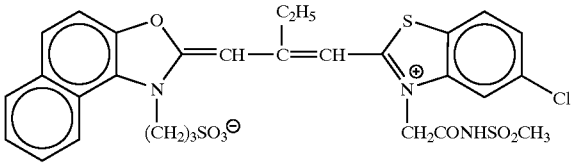

Sensitizing dye 20

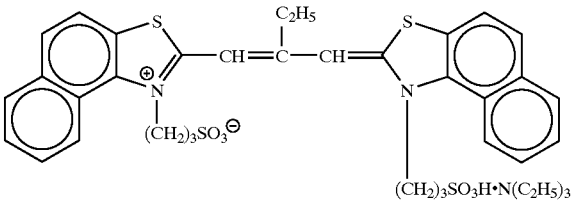

Sensitizing dye 21

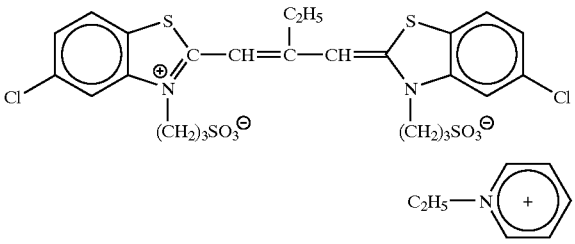

(Preparation Method of Em-K)

1200 mL of an aqueous solution containing 4.9 g of a low-molecular weight gelatin having a molecular weight of 15,00, and 5.3 g of KBr was vigorously stirred at 60° C. An aqueous solution containing 8.75 g of $AgNO_3$ and an aqueous solution containing 6.45 g of KBr were added over 1 min by the double jet method. After the temperature was raised to 75° C., 21 mL of an aqueous solution containing 6.9 g of $AgNO_3$ was added over 2 min. After sequentially adding 26 g of $NH_4NO_3$, and 56 mL of 1N NaOH, ripened the emulsion. After the completion of the ripening, pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate.

After the temperature was raised to 55° C., 240 mL of an aqueous solution containing 7.1 g of $AgNO_3$, and an aqueous solution containing 6.46 g of KI were added by the double jet method over 5 min. 4 mg of sodium benzenethiosulfonate and 0.05 mg of $K_2IrCl_6$ were added. 177 mL of an aqueous solution containing 57.2 g of $AgNO_3$, and 223 mL of an aqueous solution containing 4.02 g of KBr were added by the double jet method. The thus prepared emulsion was washed with water and chemically sensitized in almost the same manner as Em-J.

(Preparation Method of Em-L)

Em-L was prepared in almost the same manner as in Em-K, except that the temperature during nucleation was changed to 40° C.

(Preparation Method of Em-M)

Em-M was prepared in almost the same manner as in Em-J, except that the chemical sensitization was performed by almost the same manner as in Em-F.

The characteristic values of silver halide emulsion of Em-A to Em-M are set forth in Table 6.

TABLE 6

| Emulsion No. | E.C.D. (μm) C.O.V. (%) | Thickness (μm) C.O.V. (%) | Aspect ratio C.O.V. (%) | Tabu-larity | Twin plane distance (μm) C.O.V. (%) | Ratio (%) of tabular grains to total projected area | Ratio (%) of (111) face in side surfaces | I content (mol %) C.O.V. (%) | Cl content (mol %) | Surface I content (mol %) |
|---|---|---|---|---|---|---|---|---|---|---|
| Em-A | 1.98 | 0.198 | 10 | 51 | 0.014 | 92 | 23 | 15 | 0 | 4.3 |
| | 23 | 28 | 35 | | 32 | | | 17 | | |
| Em-B | 1.30 | 0.108 | 12 | 111 | 0.013 | 93 | 22 | 11 | 0 | 3.6 |
| | 25 | 27 | 38 | | 30 | | | 16 | | |
| Em-C | 1.00 | 0.083 | 12 | 145 | 0.012 | 93 | 18 | 4 | 1 | 1.8 |
| | 27 | 26 | 37 | | 30 | | | 8 | | |
| Em-D | 0.75 | 0.075 | 10 | 133 | 0.010 | 91 | 33 | 4 | 2 | 1.9 |
| | 31 | 18 | 29 | | 27 | | | 8 | | |
| Em-E | 2.02 | 0.101 | 20 | 198 | 0.013 | 99 | 20 | 7 | 0 | 2.4 |
| | 31 | 19 | 42 | | 33 | | | 7 | | |
| Em-F | 1.54 | 0.077 | 20 | 260 | 0.013 | 99 | 23 | 7 | 0 | 2.5 |
| | 26 | 18 | 33 | | 26 | | | 7 | | |
| Em-G | 1.08 | 0.072 | 15 | 208 | 0.008 | 97 | 23 | 6 | 0 | 2.0 |
| | 18 | 15 | 19 | | 22 | | | 5 | | |
| Em-H | 0.44 | 0.22 | 2 | 9 | 0.013 | 90 | 38 | 3 | 2 | 1 |
| | 16 | 13 | 9 | | 18 | | | 6 | | |
| Em-I | 0.33 | 0.165 | 2 | 12 | 0.013 | 88 | 42 | 3 | 2 | 1 |
| | 17 | 13 | 12 | | 18 | | | 6 | | |
| Em-J | 1.83 | 0.122 | 15 | 123 | 0.012 | 98 | 23 | 5 | 1 | 1.8 |
| | 18 | 20 | 22 | | 19 | | | 6 | | |
| Em-K | 1.09 | 0.156 | 7 | 45 | 0.013 | 99 | 22 | 3 | 0 | 2.7 |
| | 16 | 18 | 19 | | 16 | | | 7 | | |

TABLE 6-continued

| Emulsion No. | E.C.D. (μm) C.O.V. (%) | Thickness (μm) C.O.V. (%) | Aspect ratio C.O.V. (%) | Tabu-larity | Twin plane distance (μm) C.O.V. (%) | Ratio (%) of tabular grains to total projected area | Ratio (%) of (111) face in side surfaces | I content (mol %) C.O.V. (%) | Cl content (mol %) | Surface I content (mol %) |
|---|---|---|---|---|---|---|---|---|---|---|
| Em-L | 0.84<br>17 | 0.120<br>18 | 7<br>19 | 58 | 0.013<br>16 | 99 | 25 | 3<br>7 | 0 | 2.7 |
| Em-M | 1.83<br>18 | 0.122<br>20 | 15<br>22 | 123 | 0.012<br>19 | 98 | 23 | 5<br>6 | 1 | 1.8 |

E.C.D = Equivalent circle diameter; C.O.V. = Coefficient of variation

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.)

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Photosensitive Layers

The reverse side of the support, opposite the back layers formed as above was coated with a plurality of layers having the following compositions to form a sample 201 as a color negative photosensitive material.

(Compositions of Sensitive Layers)

The main materials used in the individual layers are classified as follows.

ExC: Cyan coupler

UV: Ultraviolet absorbent

ExM: Magenta coupler

HBS: High-boiling organic solvent

ExY: Yellow coupler

H: Gelatin hardener (Specific compounds are indicated with the numerals after the symbols and their chemical formulas are shown later in the following description.)

The number corresponding to each component indicates the coating amount in g/m$^2$. The coating amount of a silver halide is indicated by the coating amount in terms of silver.

| | | |
|---|---|---|
| 1st layer (1st antihalation layer) | | |
| Black colloidal silver | silver | 0.155 |
| 0.07 μm of surface-fogged AgBrI (2) | silver | 0.1 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |
| 3rd layer (Intermediate layer) | | |
| 0.07 μm of AgRrI (2) | | 0.020 |
| ExC-2 | | 0.022 |
| Poly(ethyl acrylate) latex | | 0.085 |
| Gelatin | | 0.294 |
| 4th layer (Low-speed red-sensitive emulsion layer) | | |
| Emulsion r of Example 2 | silver | 0.323 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion K | silver | 0.21 |
| Silver iodobromide emulsion L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |

-continued

| | | |
|---|---|---|
| 6th layer (High-speed red-sensitive emulsion layer) | | |
| Silver iodobromide emulsion J | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Intermediate layer) | | |
| Cpd-1 | | 0.089 |
| Solid disperse dye ExF-4 | | 0.030 |
| HBS-1 | | 0.050 |
| Poly(ethyl acrylate) latex | | 0.83 |
| Gelatin | | 0.84 |
| 8th layer (layer for donating interimage effect to red-sensitive layer) | | |
| Silver iodobromide emulsion E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion G | silver | 0.39 |
| Silver iodobromide emulsion H | silver | 0.28 |
| Silver iodobromide emulsion I | silver | 0.35 |
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion F | silver | 0.20 |
| Silver iodobromide emulsion G | silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Em-M | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |

-continued

| | | |
|---|---|---|
| Poly(ethyl acrylate) latex | | 0.099 |
| Gelatin | | 1.11 |
| 12th layer (Yellow filter layer) | | |
| Yellow colloidal silver | silver | 0.047 |
| Cpd-1 | | 0.16 |
| Oil-soluble dye ExF-5 | | 0.010 |
| Solid disperse dye ExF-6 | | 0.010 |
| HBS-1 | | 0.082 |
| Gelatin | | 1.057 |
| 13th layer (Low-speed blue-sensitive emulsion layer) | | |
| Silver iodobromide emulsion B | silver | 0.18 |
| Silver iodobromide emulsion C | silver | 0.20 |
| Silver iodobromide emulsion D | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| 0.07 μm of AgBrI (2) | silver | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| F-20 | | 0.005 |
| HBS-1 | | 0.12 |
| HBS-4 | | $5.0 \times 10^{-2}$ |
| Gelatin | | 2.3 |
| 16th layer (2nd protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, solid dispersions ExF-4 was obtained. The average grain sizes of the fine dye grains was 0.45 μm. ExF-2 was dispersed by a microprecipitation dispersion method described in Example 1 of EP549,489A. The average grain size was found to be 0.06 μm.

A solid dispersion ExF-6 was dispersed by the following method.

4,000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min. The average grain size was 0.52 μm.

Compounds used for the formation of each layer mentioned above are those set forth below.

ExC-1

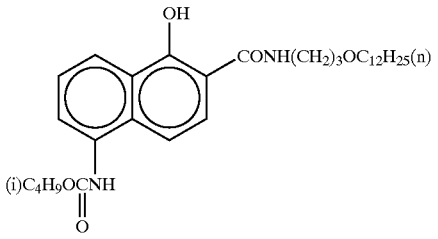

ExC-2

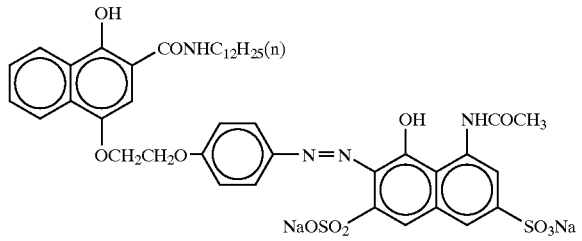

-continued
ExC-3
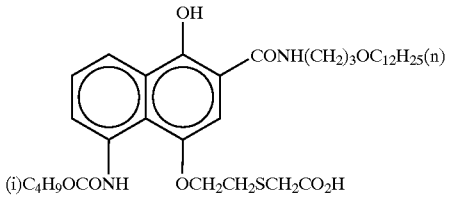
ExC-4
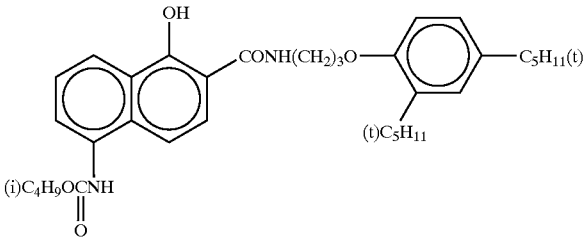
ExC-5
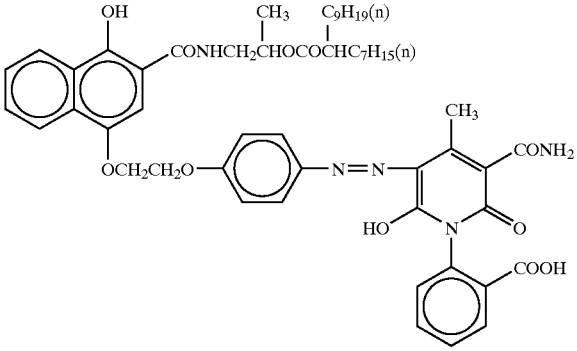
ExC-6
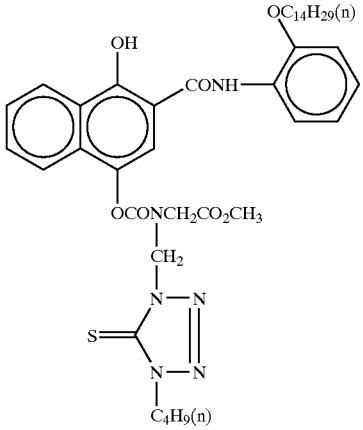
ExC-7
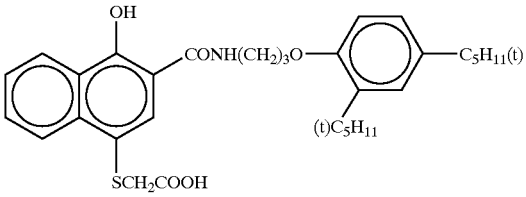
ExC-8
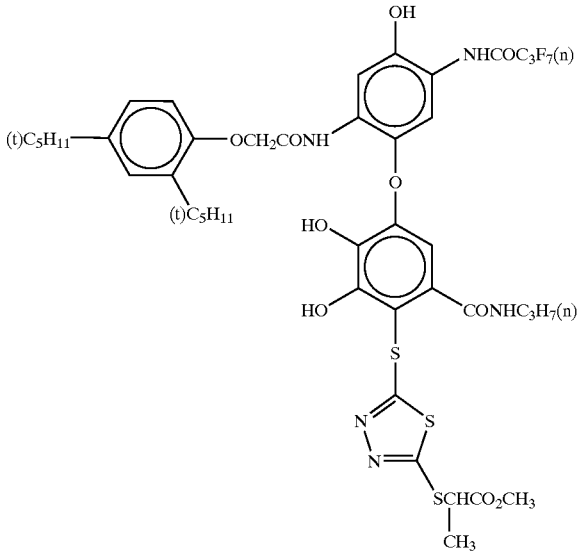

-continued
ExM-1
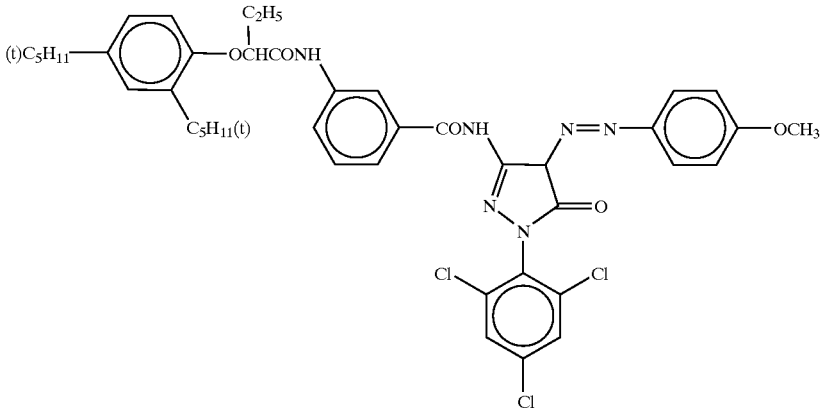
ExM-2
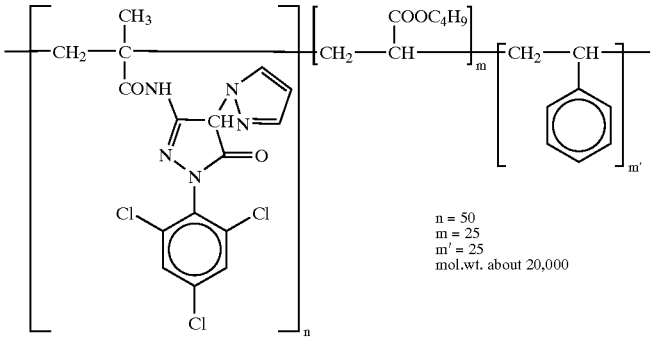
n = 50
m = 25
m′ = 25
mol.wt. about 20,000
ExM-3
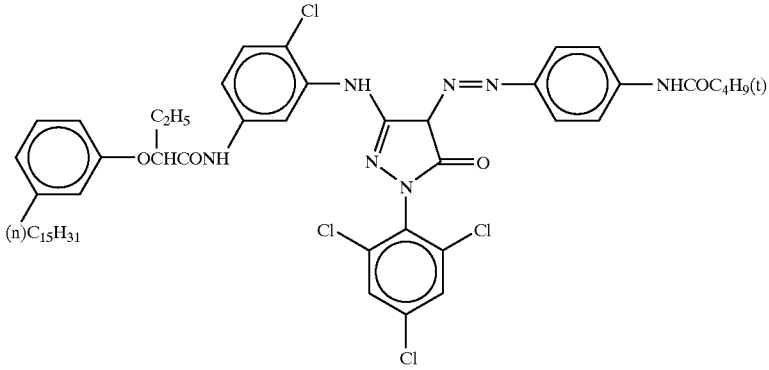
ExM-4
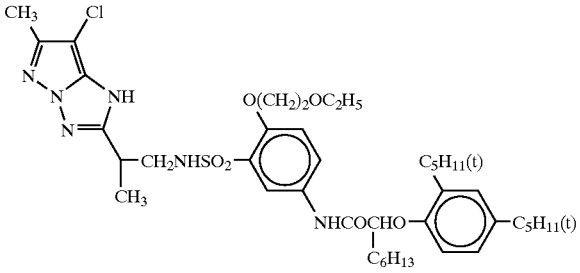
ExM-5
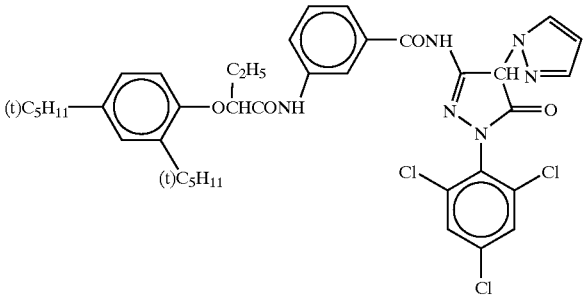

-continued
ExY-1
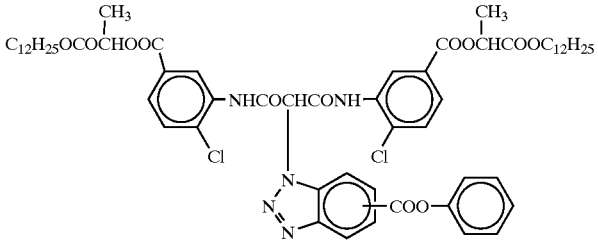
ExY-2
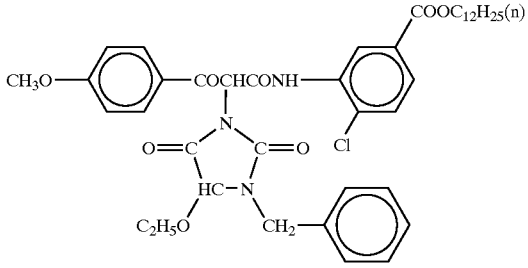
ExY-3
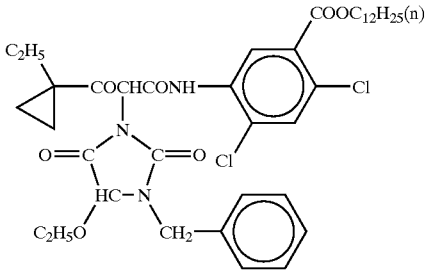
ExY-4
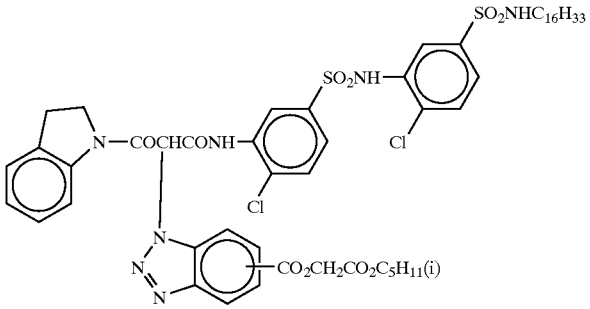
ExY-5
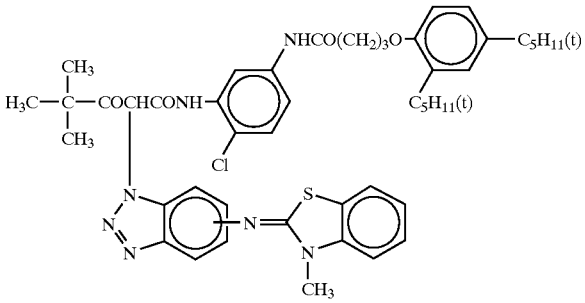
ExY-6
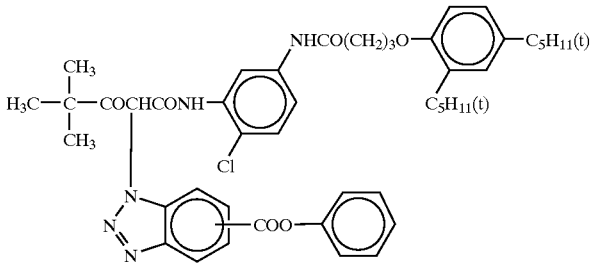
ExG-1
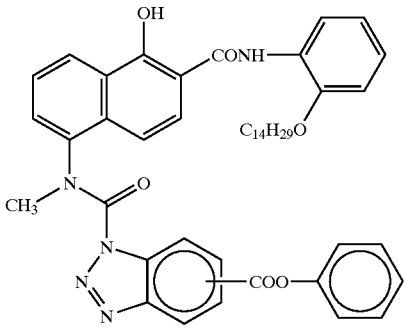
ExF-1
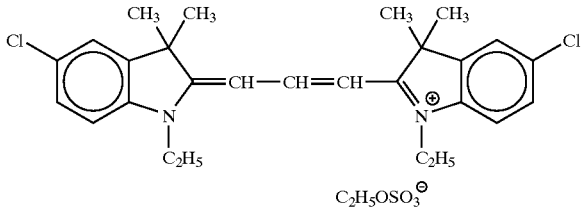
ExF-2
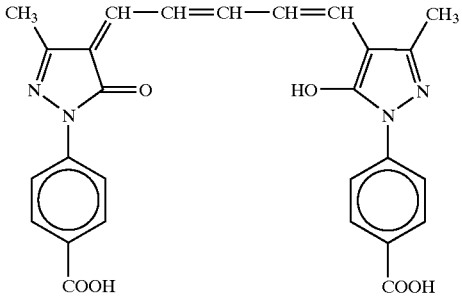

-continued
ExF-3
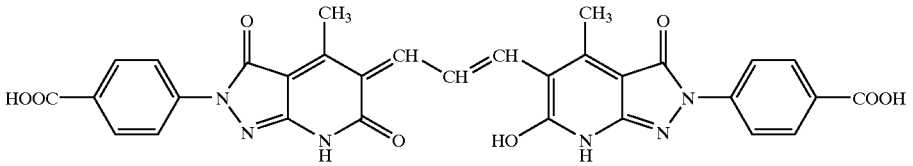
ExF-4
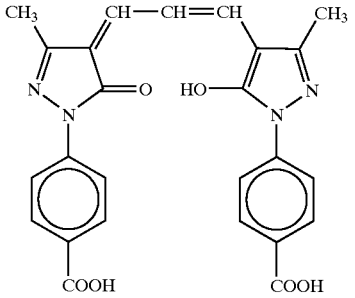
ExF-5
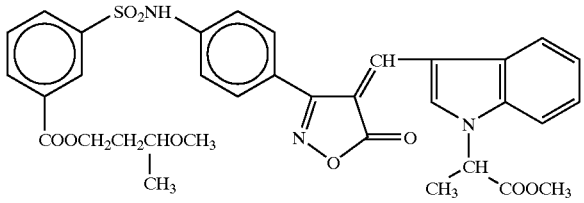
ExF-6
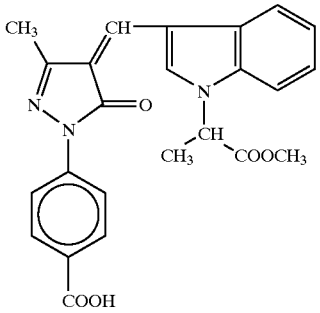
Cpd-1
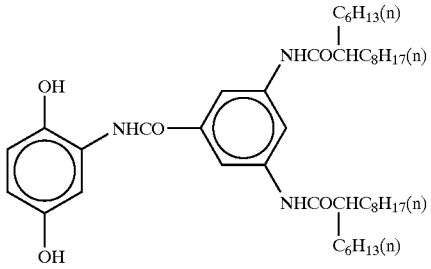
Cpd-2
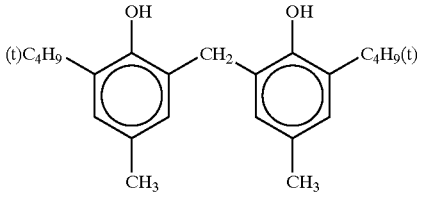
Cpd-3
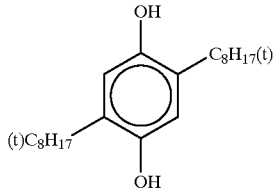
Cpd-4
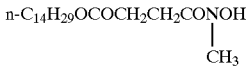
UV-1
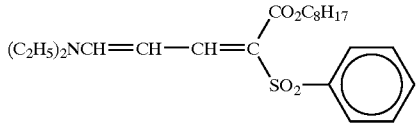
UV-2
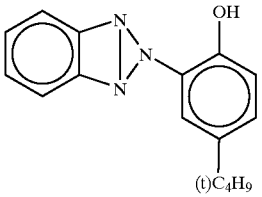
UV-3
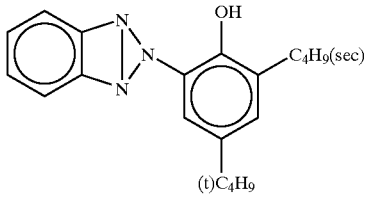
UV-4
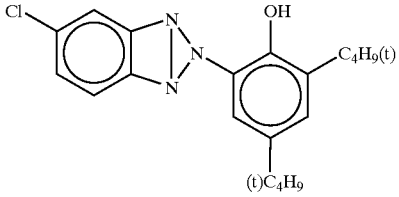
HBS-1
Tricresyl phosphate Di-n-butyl phthalate
Tri(2-ethylhexyl) phosphate
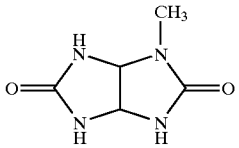
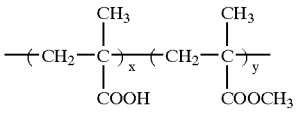
x/y = 40/60 (Weight ratio)
Average mol. wt.: about 20,000
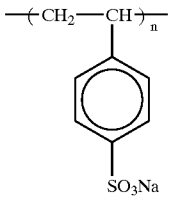
Average mol. wt.: about 750,000
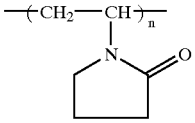
Average mol. wt.: about 10,000
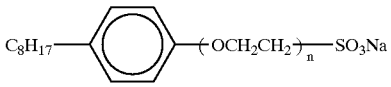
n = 2–4
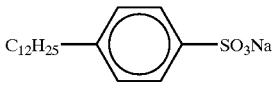
-continued
HBS-2
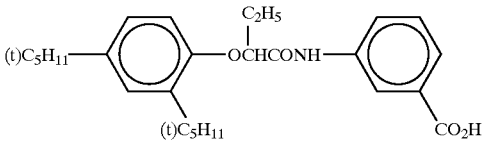
HBS-3
HBS-4
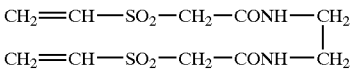
H-1
S-1
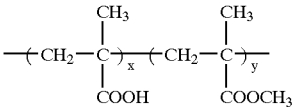
x/y = 10/90 (Weight ratio)
Average mol. wt.: about 35,000
B-1
B-2
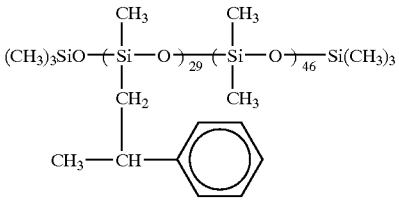
(Molar ratio)
Average mol. wt.: about 8,000
B-3
B-4
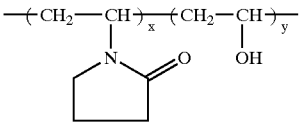
x/y = 70/30 (Weight ratio)
Average mol. wt.: about 17,000
B-5
B-6
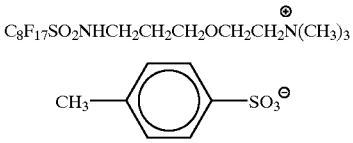
W-1
W-2
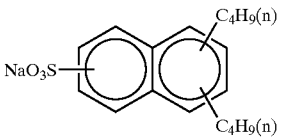
W-3
W-4
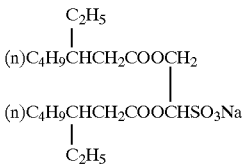
W-5

-continued
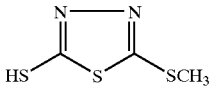
F-1
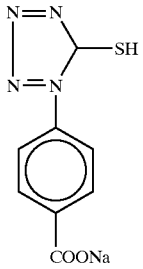
F-2
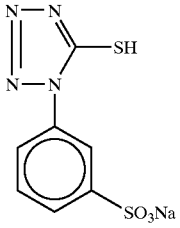
F-3
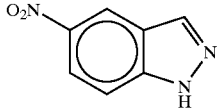
F-4
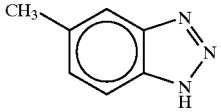
F-5
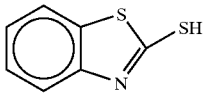
F-6
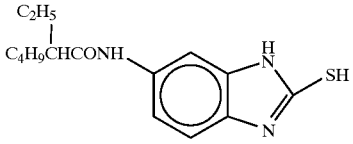
F-7
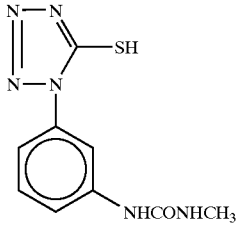
F-8
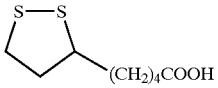
F-9
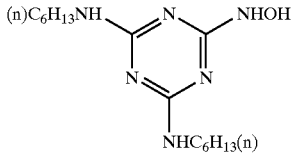
F-10
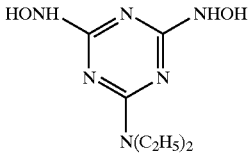
F-11
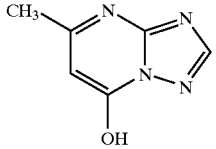
F-12
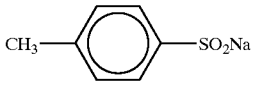
F-13
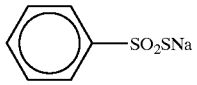
F-14
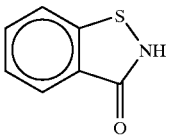
F-15
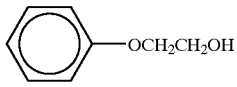
F-16
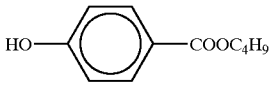
F-17
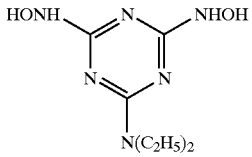
F-18

-continued

F-19

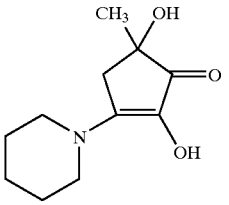

F-20

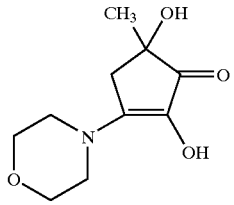

Samples 202, 203, 204, and 205 were prepared in the same as Sample 201, except that the emulsion used in the 4th layer was changed to emulsions s, t, u and v, respectively. These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution pH 6.8

| (Fixer (2)) | [Tank solution] (g) | [Replenisher] (g) |
|---|---|---|
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

TABLE 7

| Sample No. | Emulsion | Fog | Sensitivity (fog + 1.5) | Sensitivity (fog + 2.5) |
|---|---|---|---|---|
| 201 (Comp.) | r | 0.18 | 100 | 100 |
| 202 (Inv.) | s | 0.15 | 125 | 139 |
| 203 (Inv.) | t | 0.15 | 125 | 139 |
| 204 (Inv.) | u | 0.14 | 138 | 158 |
| 205 (Inv.) | v | 0.13 | 142 | 173 |

As is apparent from the results in Table 7, the use of the emulsion of the invention can provide lightsensitive material having high sensitivity and hard gradation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising silver iodochlorobromide tabular grains each having (111) faces as main planes thereof, wherein 70% or more of the total projected area of all the grains contained in the emulsion is occupied by grains each meeting conditions (i) to (iv) below:

(i) a hexagonal tabular grain whose ratio of the length of an edge having the maximum length with respect to the length of an edge having the minimum length, is 2 or less, (ii) an epitaxial junction portion having a silver chloride content of 5 mol % or more and 25 mol % or less, is provided on at least one apex portion of the hexagon, (iii) a silver chloride content thereof is 0.5 mol % or more and 6 mol % or less, and (iv) a silver iodide content thereof is 0.5 mol % or more and 10 mol % or less.

2. The silver halide photographic emulsion according to claim 1, wherein the silver chloride content of the epitaxial junction portion is 10 mol % or more and 20 mol % or less.

3. The silver halide photographic emulsion according to claim 1, wherein the silver iodide content of the epitaxial junction portion is 1 mol % or more and 10 mol % or less.

4. The silver halide photographic emulsion according to claim 3, wherein the epitaxial portion was formed by adding a silver iodide fine grain emulsion prepared immediately before the addition thereof.

5. The silver halide photographic emulsion according to claim 1, wherein each of the grains occupying 70% or more of the total projected area further meeting condition (v) below:

(v) an equivalent-circle diameter thereof is 0.3 μm or more and the thickness is 0.2 μm or less.

6. The silver halide photographic emulsion according to claim 1, wherein the variation coefficient of equivalent-circle diameters of all the grains contained in the emulsion is 30% or less.

7. The silver halide photographic emulsion according to claim 1, wherein each of the grains occupying 70% or more of the total projected area further meeting condition (vi) below:

(vi) an equivalent-circle diameter thereof is from 0.5 μm to 1.2 μm and a thickness thereof is 0.1 μm or less.

8. The silver halide photographic emulsion according to claim 1, wherein the grains occupying 70% or more of the total projected area further meeting condition (vii) below:

(vii) no dislocation lines are present anywhere other than the epitaxial junction portion.

9. A silver halide photographic emulsion comprising silver iodochlorobromide tabular grains each having (111) faces as main planes thereof, wherein the tabular grains each having a ratio of (111) face to the side surfaces of 75% or more, and 70% or more of the total projected area of all the grains contained in the emulsion is occupied by grains each meeting conditions (i), (ii'), (iii) and (iv) below:

(i) a hexagonal tabular grain whose ratio of the length of an edge having the maximum length with respect to the length of an edge having the minimum length, is 2 or less, (ii') an epitaxial junction portion is provided on at least one apex portion of the hexagon, (iii) a silver chloride content thereof is 0.5 mol % or more and to 6 mol % or less (iv) a silver iodide content thereof is 0.5 mol % or more and 10 mol % or less.

10. The silver halide photographic emulsion according to claim 9, wherein the epitaxial junction portion has a silver chloride content of 5 mol % or more and 25 mol % or less.

11. The silver halide photographic emulsion according to claim 10, wherein the silver chloride content of the epitaxial junction portion is 10 mol % or more and 20 mol % or less.

12. The silver halide photographic emulsion according to claim 10, wherein the silver iodide content of the epitaxial junction portion is 1 mol % or more and 10 mol % or less.

13. The silver halide photographic emulsion according to claim 12, wherein the epitaxial portion was formed by adding a silver iodide fine grain emulsion prepared immediately before the addition thereof.

14. The silver halide photographic emulsion according to claim 10, wherein the ratio of (111) face to the side surfaces is 85% or more.

15. The silver halide photographic emulsion according to claim 10, wherein each of the grains occupying 70% or more of the total projected area further meeting condition (v) below:

(v) an equivalent-circle diameter thereof is 0.3 μm or more and the thickness is 0.2 μm or less.

16. The silver halide photographic emulsion according to claim 10, wherein the variation coefficient of equivalent-circle diameters of all the grains contained in the emulsion is 30% or less.

17. The silver halide photographic emulsion according to claim 10, wherein each of the grains occupying 70% or more of the total projected area further meeting condition (vi) below:

(vi) an equivalent-circle diameter thereof is from 0.5 μm to 1.2 μm and a thickness thereof is 0.1 μm or less.

18. The silver halide photographic emulsion according to claim 10, wherein the grains occupying 70% or more of the total projected area further meeting condition (vii) below:

(vii) no dislocation lines are present anywhere other than the epitaxial junction portion.

19. The silver halide photographic emulsion according to claim 9, wherein the ratio of (111) face to the side surfaces is 85% or more.

20. The silver halide photographic emulsion according to claim 9, wherein host tabular grains on which the epitaxial junction portion is deposited were formed by adding a silver iodide fine grain emulsion prepared immediately before the addition thereof.

* * * * *